US012637268B2

(12) United States Patent
Naukkarinen

(10) Patent No.: US 12,637,268 B2
(45) Date of Patent: May 26, 2026

(54) SEALING DISC FOR PAPERBOARD CONTAINER AND A PACKAGING CONTAINER COMPRISING THE SEALING DISC

(71) Applicant: GPI Systems AB, Lund (SE)

(72) Inventor: Anna Naukkarinen, Helsingborg (SE)

(73) Assignee: GPI Systems AB, Lund (SE)

( * ) Notice: Subject to any disclaimer, the term of this patent is extended or adjusted under 35 U.S.C. 154(b) by 867 days.

(21) Appl. No.: 17/628,034

(22) PCT Filed: Jul. 15, 2020

(86) PCT No.: PCT/SE2020/050736
§ 371 (c)(1),
(2) Date: Jan. 18, 2022

(87) PCT Pub. No.: WO2021/010889
PCT Pub. Date: Jan. 21, 2021

(65) Prior Publication Data

US 2022/0267061 A1 Aug. 25, 2022

(30) Foreign Application Priority Data

Jul. 16, 2019 (SE) ..... 1950900-9

(51) Int. Cl.
*B65D 51/20* (2006.01)
*B65D 5/74* (2006.01)
(Continued)

(52) U.S. Cl.
CPC ..... *B65D 51/20* (2013.01); *B65D 5/742* (2013.01); *B65D 15/08* (2013.01);
(Continued)

(58) Field of Classification Search
CPC ..... B65D 51/20; B65D 51/22; B65D 2251/0093; B65D 2577/0291;
(Continued)

(56) References Cited

U.S. PATENT DOCUMENTS 1,064,787 A 6/1913 Taylor
1,396,282 A 11/1921 Penn
(Continued)

FOREIGN PATENT DOCUMENTS

CH 280201 A 1/1952
CN 88102720 A 11/1988
(Continued)

OTHER PUBLICATIONS

International Search Report for PCT/SE2020/050736 dated Sep. 17, 2020. 6 pgs.
(Continued)

*Primary Examiner* — Don M Anderson
*Assistant Examiner* — Jennifer Castriotta
(74) *Attorney, Agent, or Firm* — Andrew N. Claerbout; FisherBroyles, LLP

(57) ABSTRACT

A sealing disc for sealing an inner compartment in a packaging container includes a first surface and a second surface. The sealing disc is delimited by a sealing disc outer edge. Additionally, the sealing disc includes a peripheral edge portion surrounding at least two fully or partly removable tear-open parts. Each fully or partly removable tear-open part is arranged to be fully or partly separated from the peripheral edge portion along a contour line.

21 Claims, 10 Drawing Sheets

(51) Int. Cl.
*B65D 8/00* (2006.01)
*B65D 17/28* (2006.01)

(52) U.S. Cl.
CPC ..... *B65D 17/4011* (2018.01); *B65D 17/4012* (2018.01); *B65D 2251/0018* (2013.01); *B65D 2251/0093* (2013.01); *B65D 2543/00296* (2013.01); *B65D 2577/2091* (2013.01)

(58) Field of Classification Search
CPC ..... B65D 2577/205; B65D 17/4011; B65D 17/4012; B65D 47/103; B65D 5/742; B65D 81/3283; B65D 3/24
See application file for complete search history.

(56) References Cited

U.S. PATENT DOCUMENTS 1,515,277 A 11/1924 Root
1,534,803 A 4/1925 Moore
1,733,674 A 10/1929 Leiman
2,073,636 A 3/1937 Holoubek
2,076,407 A 4/1937 Mandell
2,281,854 A 5/1942 Miller, Jr.
2,314,338 A 3/1943 Graves
2,317,651 A 4/1943 Talbot
2,324,670 A 7/1943 Bergen
2,348,377 A 5/1944 Goodyear
2,371,173 A 3/1945 Hothersall
2,409,655 A 10/1946 Annen
2,568,697 A 9/1951 Amberg
2,569,851 A 10/1951 Farrell
2,608,341 A 8/1952 Eckman
2,760,629 A 8/1956 Thagard, Jr.
2,795,366 A 6/1957 Magill
2,832,514 A 4/1958 O'Connor
2,891,713 A 6/1959 O'Neil
2,898,025 A 8/1959 Walker
2,948,454 A 8/1960 Gillmore
3,042,285 A 7/1962 Smith
3,042,288 A 7/1962 Carpenter, Sr.
3,049,277 A 8/1962 Shappell
3,089,609 A * 5/1963 D Andrea ..... B65D 17/4012 D9/438
3,101,885 A 8/1963 Walsh
3,109,576 A 11/1963 Karl
3,195,763 A 7/1965 Fried
3,195,799 A 7/1965 Denenberg
3,334,778 A * 8/1967 Saunders ..... A47G 21/04 229/401
3,391,852 A * 7/1968 Waldrop ..... B65D 77/2008 229/207
3,401,824 A 9/1968 Rouse
3,402,876 A 9/1968 Kuchenbecker
3,409,206 A 11/1968 Slouka et al.
3,445,049 A 5/1969 Carpenter, Jr.
3,506,183 A 4/1970 Turpin et al.
3,655,111 A 4/1972 Surerus
3,669,346 A 6/1972 Leezer et al.
3,696,987 A 10/1972 Schuff
3,940,496 A 2/1976 Turpin et al.
4,078,686 A 3/1978 Karesh
4,091,929 A 5/1978 Krane
4,091,984 A 5/1978 McFarland
4,198,901 A 4/1980 Knudsen
4,207,725 A 6/1980 Smith
4,210,618 A 7/1980 Piltz
4,495,209 A 1/1985 Whiteside
4,533,063 A 8/1985 Buchner et al.
4,556,152 A 12/1985 Bogren
4,606,462 A 8/1986 Bogren
4,621,736 A 11/1986 Roccaforte
4,632,298 A 12/1986 Schellenberg
4,736,870 A 4/1988 Christensson
4,804,101 A 2/1989 Heath
4,850,503 A 7/1989 Larsson
4,865,203 A 9/1989 Ueda
4,883,193 A 11/1989 Christensson
4,888,222 A 12/1989 Gibbons
4,921,121 A 5/1990 Duvander et al.
4,930,682 A 6/1990 Gordon et al.
5,407,107 A 4/1995 Smith
5,487,506 A 1/1996 Drummond et al.
5,511,680 A 4/1996 Kinne
5,514,394 A 5/1996 Lenahan
5,566,529 A 10/1996 Sireix
5,617,705 A 4/1997 Sanfilippo et al.
5,641,118 A 6/1997 Benham
5,685,480 A 11/1997 Choi
5,752,646 A 5/1998 Sandstrom
5,803,294 A 9/1998 Bello et al.
5,820,016 A 10/1998 Stropkay
5,897,019 A 4/1999 Stropkay
5,950,917 A 9/1999 Smith
6,047,878 A 4/2000 Lowry
6,092,717 A 7/2000 Lowry
6,165,114 A 12/2000 Stahlecker et al.
6,251,203 B1 6/2001 Vala et al.
6,325,232 B1 12/2001 Luttmann
6,415,940 B1 7/2002 Brabson, II
6,450,351 B1 9/2002 Thompson
6,644,541 B2 11/2003 Stewart
6,761,279 B1 7/2004 Martin et al.
7,169,418 B2 1/2007 Dalton
7,201,714 B2 4/2007 Zoeckler et al.
7,370,788 B1 5/2008 Otani et al.
7,703,625 B2 4/2010 Westphal
7,757,879 B2 7/2010 Schuetz
7,798,319 B1 9/2010 Bried
8,025,171 B2 9/2011 Cassol
8,220,701 B2 7/2012 Fontaine et al.
8,317,671 B1 11/2012 Zoeckler
8,403,819 B2 3/2013 Zoeckler
8,403,820 B2 3/2013 Zoeckler
8,684,224 B2 4/2014 House
8,915,395 B2 12/2014 Gersovitz
9,387,963 B2 7/2016 McBroom
9,718,574 B2 8/2017 Sireix
9,815,579 B2 11/2017 Larsson et al.
9,821,527 B2 11/2017 Hagelqvist
9,957,081 B2 * 5/2018 Gayer ..... B65D 17/4011
9,975,305 B2 5/2018 Strand et al.
10,370,158 B2 8/2019 Herlin et al.
10,730,660 B2 8/2020 Herlin et al.
10,736,468 B2 8/2020 Herlin et al.
10,787,280 B2 9/2020 Herlin et al.
11,111,062 B2 9/2021 Herlin et al.
11,192,688 B2 12/2021 Herlin et al.
2002/0107127 A1 8/2002 Buisson
2002/0130126 A1 9/2002 Rosenberg
2003/0111522 A1 6/2003 Deering et al.
2003/0183540 A1 10/2003 Onishi
2004/0050437 A1 3/2004 Engel et al.
2004/0142133 A1 7/2004 De Coninck
2004/0206052 A1 10/2004 Shean
2004/0238553 A1 12/2004 Lane et al.
2005/0051461 A1 3/2005 Bryant
2005/0173501 A1 8/2005 Jones
2005/0189406 A1 9/2005 Welchel et al.
2005/0190995 A1 9/2005 Koyanagi
2005/0223680 A1 10/2005 Sireix
2005/0252952 A1 11/2005 Nomula
2006/0057315 A1 3/2006 De Coninck et al.
2006/0124719 A1 6/2006 Mannlein
2006/0254942 A1 11/2006 Cargile, Jr.
2006/0257534 A1 11/2006 Maddock
2006/0289542 A1 12/2006 Schedl
2007/0090105 A1 4/2007 Elgebrant
2007/0145001 A1 6/2007 Tilto
2007/0157577 A1 7/2007 Buisson
2007/0170236 A1 7/2007 Rasanen
2007/0234667 A1 10/2007 Lubker et al.
2007/0235512 A1 10/2007 Drummond
2008/0041861 A1 2/2008 Crawford et al.
2008/0110896 A1 5/2008 Westphal

(56) References Cited

U.S. PATENT DOCUMENTS

| | | | | |
|---|---|---|---|---|
| 2008/0156805 | A1 | 7/2008 | Perry et al. | |
| 2008/0156808 | A1 | 7/2008 | Perry et al. | |
| 2009/0039078 | A1 | 2/2009 | Sanfilippo et al. | |
| 2009/0177179 | A1 | 7/2009 | Engelbrecht | |
| 2009/0236346 | A1 | 9/2009 | Hofeldt et al. | |
| 2009/0314775 | A1 | 12/2009 | Dietrich et al. | |
| 2010/0018883 | A1 | 1/2010 | Patel | |
| 2010/0065557 | A1 | 3/2010 | Gersovitz | |
| 2010/0108670 | A1 | 5/2010 | Perry et al. | |
| 2010/0133127 | A1 | 6/2010 | Jenner | |
| 2010/0140129 | A1 | 6/2010 | Sanfilippo | |
| 2010/0142862 | A1 | 6/2010 | Sam | |
| 2010/0180553 | A1 | 7/2010 | Tilton | |
| 2010/0270301 | A1 | 10/2010 | Cronin | |
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2011/0006066 | A1 | 1/2011 | Vandamme et al. | |
| 2011/0240666 | A1 | 10/2011 | Mihaylov | |
| 2011/0253725 | A1 | 10/2011 | Killian | |
| 2012/0103353 | A1 | 5/2012 | Sebastian et al. | |
| 2012/0125932 | A1 | 5/2012 | Sierra-Gomez | |
| 2012/0298733 | A1 | 11/2012 | Xu et al. | |
| 2013/0029823 | A1 | 1/2013 | Zoeckler | |
| 2013/0048125 | A1 | 2/2013 | Hoffman et al. | |
| 2013/0092312 | A1 | 4/2013 | Cassoni | |
| 2013/0186901 | A1 | 7/2013 | Lejon et al. | |
| 2014/0109522 | A1 | 4/2014 | Sanfilippo | |
| 2014/0215973 | A1 | 8/2014 | Hagelqvist | |
| 2014/0262903 | A1 | 9/2014 | Mitten | |
| 2014/0287901 | A1 | 9/2014 | Hagelqvist | |
| 2015/0038309 | A1 | 2/2015 | Hoffman et al. | |
| 2015/0041470 | A1 | 2/2015 | Huffer et al. | |
| 2015/0099616 | A1 | 4/2015 | Chapman et al. | |
| 2015/0148208 | A1 | 5/2015 | Sireix | |
| 2015/0158632 | A1* | 6/2015 | Wilhelm | B65D 47/263 426/120 |
| 2016/0000270 | A1 | 1/2016 | Wiggins et al. | |
| 2016/0137377 | A1 | 5/2016 | Tracy | |
| 2017/0073142 | A1 | 3/2017 | Loomis et al. | |
| 2017/0247159 | A1 | 8/2017 | Hansen | |
| 2017/0283136 | A1 | 10/2017 | Branyon | |
| 2017/0297769 | A1 | 10/2017 | Gersovitz | |
| 2018/0016038 | A1 | 1/2018 | Herlin et al. | |
| 2018/0022505 | A1 | 1/2018 | Herlin et al. | |
| 2018/0170613 | A1* | 6/2018 | Hu | B65D 17/4012 |
| 2018/0194527 | A1 | 7/2018 | Sasaki et al. | |
| 2018/0229907 | A1 | 8/2018 | Gayer | |
| 2018/0237206 | A1 | 8/2018 | Jobe | |
| 2018/0311940 | A1 | 11/2018 | Toft et al. | |
| 2019/0127100 | A1 | 5/2019 | Herlin et al. | |
| 2019/0127107 | A1 | 5/2019 | Herlin et al. | |
| 2019/0135508 | A1 | 5/2019 | Sunning et al. | |
| 2019/0256230 | A1 | 8/2019 | Holka | |
| 2021/0070520 | A1 | 3/2021 | Huffer | |
| 2021/0206544 | A1 | 7/2021 | Holka et al. | |
| 2022/0135260 | A1 | 5/2022 | Larsson | |
| 2022/0363427 | A1 | 11/2022 | Andersson | |
| 2023/0054953 | A1 | 2/2023 | Graham | |

FOREIGN PATENT DOCUMENTS

| | | | |
|---|---|---|---|
| CN | 1189804 | A | 8/1998 |
| CN | 1914096 | A | 2/2007 |
| CN | 2915695 | Y | 6/2007 |
| CN | 101391493 | A | 3/2009 |
| CN | 201338810 | | 11/2009 |
| CN | 101754912 | | 6/2010 |
| CN | 102190118 | A | 9/2011 |
| CN | 101670909 | B | 1/2012 |
| CN | 102991764 | A | 3/2013 |
| CN | 103895952 | A | 7/2014 |
| CN | 103979180 | A | 8/2014 |
| CN | 104812680 | A | 7/2015 |
| CN | 107108068 | A | 8/2017 |
| CN | 206954829 | U | 2/2018 |
| CN | 109153475 | A | 1/2019 |
| CN | 208559788 | U | 3/2019 |
| DE | 884862 | C | 7/1953 |
| DE | 3411371 | A1 | 10/1985 |
| DE | 102005026903 | A1 | 8/2006 |
| DE | 10 2011 014 844 | A1 | 9/2012 |
| DE | 10 2014 000 543 | A1 | 7/2015 |
| EP | 0 013 132 | A1 | 7/1980 |
| EP | 0 062 929 | A2 | 10/1982 |
| EP | 0 094 359 | A2 | 11/1983 |
| EP | 0 104 548 | B1 | 6/1987 |
| EP | 0 312 513 | A2 | 4/1989 |
| EP | 0 370 982 | A1 | 5/1990 |
| EP | 0 611 703 | A2 | 8/1994 |
| EP | 0820936 | A2 | 1/1998 |
| EP | 1 052 181 | A1 | 11/2000 |
| EP | 1 818 259 | A2 | 8/2007 |
| EP | 1 842 792 | A1 | 10/2007 |
| EP | 1 035 025 | B1 | 3/2011 |
| EP | 2 716 551 | A1 | 4/2014 |
| EP | 2 719 637 | A1 | 4/2014 |
| EP | 2 731 874 | A1 | 5/2014 |
| EP | 2 927 132 | A1 | 10/2015 |
| EP | 3 085 636 | A1 | 10/2016 |
| EP | 3 095 600 | A1 | 11/2016 |
| EP | 3162553 | A1 | 5/2017 |
| EP | 3 409 470 | A1 | 2/2018 |
| EP | 3 342 720 | A1 | 7/2018 |
| EP | 3 442 875 | | 2/2019 |
| EP | 3 481 727 | | 5/2019 |
| EP | 3 546 387 | | 10/2019 |
| EP | 3 578 477 | | 12/2019 |
| FR | 1 358 396 | | 4/1964 |
| FR | 828311 | A | 5/1983 |
| FR | 2716408 | A1 | 8/1995 |
| FR | 2 981 333 | | 4/2013 |
| FR | 2986514 | A1 | 8/2013 |
| FR | 3043069 | | 5/2017 |
| GB | 190722536 | A | 10/1908 |
| GB | 1911 00947 | A | 12/1911 |
| GB | 819960 | A | 9/1959 |
| GB | 920354 | A | 3/1963 |
| GB | 998 102 | A | 7/1965 |
| GB | 1 038 995 | | 8/1966 |
| GB | 2 281 895 | A | 3/1995 |
| GB | 2526548 | A1 | 12/2015 |
| JP | S5476383 | | 6/1979 |
| JP | S58-216539 | A | 12/1983 |
| JP | S5962435 | A | 4/1984 |
| JP | S60501305 | A | 8/1985 |
| JP | S61217350 | A | 9/1986 |
| JP | S6375 | A | 1/1988 |
| JP | H0285118 | A | 3/1990 |
| JP | H05-58640 | U | 8/1993 |
| JP | H09-99939 | A | 4/1997 |
| JP | H09-290822 | A | 11/1997 |
| JP | 3025434 | B2 | 3/2000 |
| JP | 2000-203612 | A | 7/2000 |
| JP | 2001-030383 | | 2/2001 |
| JP | 2003-231191 | | 8/2003 |
| JP | 2004-001884 | A | 1/2004 |
| JP | 2004-018100 | A | 1/2004 |
| JP | 2004-026197 | A | 1/2004 |
| JP | 2004-155478 | A | 6/2004 |
| JP | 2004-315094 | A | 11/2004 |
| JP | 2004-535993 | | 12/2004 |
| JP | 2005-041515 | | 2/2005 |
| JP | 2005153899 | | 6/2005 |
| JP | 2005-219319 | | 8/2005 |
| JP | 2005-333802 | | 12/2005 |
| JP | 3843510 | B2 | 11/2006 |
| JP | 2007-145415 | A | 6/2007 |
| JP | 2010-284866 | A | 12/2010 |
| JP | 2015-174690 | | 10/2015 |
| JP | 2016-084169 | A | 5/2016 |
| JP | 2016-088524 | A | 5/2016 |
| JP | 2016-179849 | A | 10/2016 |

(56) References Cited

FOREIGN PATENT DOCUMENTS

| | | | |
|---|---|---|---|
| JP | 2017-074951 | A | 4/2017 |
| JP | 2019-137067 | | 8/2019 |
| JP | 6596835 | B2 | 10/2019 |
| JP | 2020-039532 | A | 3/2020 |
| KR | 10-2007-0113467 | | 11/2005 |
| RU | 2 188 783 | C2 | 9/2002 |
| SE | 453821 | B | 3/1988 |
| SE | 1651162 | A1 | 3/2018 |
| SU | 1433404 | A3 | 10/1988 |
| WO | WO 84/04511 | A1 | 11/1984 |
| WO | WO 87/03536 | A1 | 6/1987 |
| WO | WO 91/14623 | A1 | 10/1991 |
| WO | WO 03/039201 | | 5/2003 |
| WO | WO 2004/060767 | A1 | 7/2004 |
| WO | WO 2005/032959 | A1 | 4/2005 |
| WO | 2005075314 | A2 | 8/2005 |
| WO | WO 2005/75314 | A2 | 8/2005 |
| WO | WO 2006/068585 | A1 | 6/2006 |
| WO | WO 2009/130043 | | 10/2009 |
| WO | WO 2020/211939 | A1 | 10/2010 |
| WO | WO 2011/052507 | A1 | 5/2011 |
| WO | WO 2013/009227 | A1 | 1/2013 |
| WO | WO 2013/057392 | A1 | 4/2013 |
| WO | WO 2013/109174 | A1 | 7/2013 |
| WO | 2014011938 | A2 | 1/2014 |
| WO | WO 2014/062119 | A1 | 4/2014 |
| WO | WO 2015/145600 | | 10/2015 |
| WO | WO 2015/145601 | | 10/2015 |
| WO | WO 2015/187004 | A1 | 12/2015 |
| WO | WO 2016/030071 | A1 | 3/2016 |
| WO | WO 2016/034462 | A1 | 3/2016 |
| WO | WO 2016/126191 | A1 | 8/2016 |
| WO | WO 2016/126193 | A1 | 8/2016 |
| WO | 2017180056 | A1 | 10/2017 |
| WO | 2018009134 | A1 | 1/2018 |
| WO | WO 2018/009128 | A1 | 1/2018 |
| WO | WO 2018/009130 | A1 | 1/2018 |
| WO | WO 2018/009136 | A1 | 1/2018 |
| WO | WO 2018/009138 | A1 | 1/2018 |
| WO | WO 2018/217156 | A1 | 11/2018 |
| WO | WO 2019/068384 | A1 | 4/2019 |
| WO | WO 2019/226097 | A1 | 11/2019 |
| WO | WO 2020/261170 | A1 | 12/2020 |

OTHER PUBLICATIONS

Machine Translation of JP S58-216539 A to Tomoo (Year: 1983).
Notification of the First Office Action for Chinese Application No. 2020800505870 dated Jun. 7, 2024 with English translation.
Machine Translation of WO 2019/068384 A1 (2019).
Supplementary European Search Report for EP 20 84 0423 dated Sep. 19, 2023.

* cited by examiner

SEALING DISC FOR PAPERBOARD CONTAINER AND A PACKAGING CONTAINER COMPRISING THE SEALING DISC

CROSS-REFERENCE TO RELATED APPLICATIONS

The present application is a national phase entry under 35 U.S.C. § 371 of International Application No. PCT/SE2020/050736 filed Jul. 15, 2020, which published in English and claims priority to Swedish Application No. 1950900-9, filed Jul. 16, 2019, all of which are incorporated herein by reference.

TECHNICAL FIELD

The disclosure pertains to a sealing disc for sealing an inner compartment in a packaging container for bulk solids. More specifically, the present disclosure pertains to a sealing disc providing improved pouring characteristics. The present disclosure also pertains to a packaging container comprising the sealing disc.

BACKGROUND OF THE INVENTION

When packaging consumer goods, and in particular when packaging bulk solids, such as dry flowable consumer goods, it is common to use rigid paperboard packaging containers which serve as protective transport and storage containers at the retail end and as storage and dispensing containers at the consumer end. Such paperboard containers are usually provided with an openable and closable lid, and with an inner removable or breakable transport closure which keeps the contents fresh and protected against contamination up until the container is opened by a consumer.

It is known to provide the packages with means to facilitate for the consumer to gain access to the product. A common type of transport seal is a sealing disc comprising a tear-away part which is opened by a push-tab and/or pull-tab. The tear-open part is delimited by a contour cut which forms an outer tear line delimiting the tear-open part from the sealing disc peripheral edge portion which is glued or welded to the inner wall of the container. By pulling at the pull-tab or pushing at the push-tab the outer tear line will break at the contour line and the area constituting the tear-away part of the sealing disc can be removed from the container opening and make the contents in the container available for use.

However, it has been found that when the tear-open part has been removed from the sealing disc and the packaged contents have been made readily accessible for scooping out of the container, the container has poor pouring properties. In particular when the container is newly opened and relatively full, it may be difficult to accurately pour a desired quantity out of the packaging container. Accordingly there remains a need for a further improved opening arrangement for a sealing disc for packaging containers as disclosed herein.

An object of the present disclosure is to provide a sealing disc having a more versatile opening arrangement wherein the user at the consumer end can choose to gain access to the content of the packaging container according to the required need. A further object is to offer a solution to improve the pourable feature of a container comprising a sealing disc.

SUMMARY OF THE INVENTION

The above and other objects may be provided by a sealing disc according to claim 1 and a paperboard packaging container according to claim 21. Further embodiments are set out in the dependent claims, in the following description and in the drawings.

As such, the present disclosure relates to a sealing disc for sealing an inner compartment in a packaging container. The sealing disc has a first surface and a second surface and is delimited by a sealing disc outer edge. The sealing disc comprises a peripheral edge portion surrounding at least two fully or partly removable tear-open parts, each of which are being arranged to be fully or partly separated from said peripheral edge portion along a contour line. One or more hinge folding lines are arranged between a pair of interruption points on the contour line and partly delimit the one or more fully or partly removable tear-open parts from the peripheral edge portion.

The first surface of the sealing disc is configured to face towards the opening and the lid of the packaging container, and the second surface is configured to face the interior comprising the content of the packaging container. The peripheral edge portion of the sealing disc is configured to be attached to the inner surface of the container wall by welding or gluing. Advantageously a tight seal is formed between the peripheral edge portion and the inner wall such that when one or more of the fully or partly removable tear-open parts are removed from the sealing disc the peripheral edge portion of the sealing disc remains firmly attached to the inner wall of the container body. The sealing disc may alternatively be attached to the top end of the container wall, e.g. to a curled top end of the container wall, or to a reinforcement rim surrounding the container opening.

The hinge folding lines offer higher resistance to tearing than the tear lines and will prevent full removal of the fully or partly removable tear-open parts from the sealing disc. However, it is conceivable to provide the sealing disc with tear indications extending also along the hinge folding lines. Such tear indications may be configured to facilitate tearing along a hinge folding line, should a user wish to remove the tear-open part completely instead of merely folding it up along the hinge folding line. Tear indications along the hinge folding lines are preferably made such that tearing along the hinge folding lines requires more force than tearing along the regular tear lines. This may be accomplished e.g. by the provision of spaced-apart cuts or perforations arranged along the hinge folding lines.

Furthermore, the hinge folding lines enable the fully or partly removable tear-open parts to be folded outwards, upwards and away from the sealing disc surface and provide an access opening in the sealing disc corresponding to the size of the fully or partly removable tear-open part.

At least one or all of the fully or partly removable tear-open parts may be provided with an opening arrangement such as e.g. one or more pull-tabs, grip-tabs, opening rings, etc. which are well known in art. In order to facilitate the gripping and pulling of a pull-tab, the pull-tab is advantageously exposed from the fully or partly removable tear-open part.

The fully or partly removable tear-open parts of the sealing disc may also be opened by means of a push-tab being pressed downwards and into the packaging container. The push-tab is in this situation advantageously folded downwards along a folding line and in under the fully or partly removable tear-open part towards the interior of the container body. Furthermore, one or more fully or partly removable tear-open part may be constituted by a push-in part such that the fully or partly removable tear-open part is torn along the contour line by pushing the fully or partly removable tear-open part into the container body.

The sealing disc may comprise one or more separating tear lines extending between one or more pairs of intersections arranged on the contour line and delimiting the fully or partly removable tear-open parts from each other. The separating tear lines may also delimit the fully or partly removable tear-open parts from sections intended to remain in the sealing disc after one or more fully or partly removable tear-open part has been fully or partly removed.

The separating tear lines extend from a first intersection of a pair of intersections arranged on the contour line, and across the first surface of the sealing disc to a second intersection of the pair of intersections which is arranged on the contour line of the sealing disc opposite to the first intersection. The separating tear lines may have any suitable shape. Accordingly, the separating tear lines may be straight tear lines or may have a curved outline, or an outline composed of straight segments and/or curved segments. A separating tear line may be non-straight e.g. to accommodate a tear strip, to create a suitably shaped opening for pouring or for inserting a scoop, etc.

One or more tear lines may be arranged along the contour line. The tear lines fully or partly delimit one or more of the fully or partly removable tear-open parts from the peripheral edge portion of the sealing disc. One or more tear lines may meet with a separating tear line at the intersections, and during the tearing action of the fully or partly removable tear-open parts, the tearing action is propagated along the tear lines or separating tear lines until it reaches an intersection where tearing is discontinued.

A folded out tear-open part may serve as a slide when pouring out contents from the packaging container. When the tear-open parts have been completely removed from the sealing disc, the peripheral edge portion remaining on the inner wall of the container body may obstruct the contents inside the container from being poured unimpededly through the access opening. This problem may be at least partly remedied by the provision of a folded out tear-open part which bridges the peripheral sealing disc edge and allows the contents to flow out on the folded out tear-open part.

Advantageously, one or more of the fully or partly removable tear-open parts are provided with spout folding lines extending from the pair of interruption points to the separating tear line on the second surface of the sealing disc to form a pouring spout.

The pouring spouts provided by folding the fully or partly removable tear-open parts further facilitates passing of the flowable content across the peripheral edge portion of the sealing disc.

A further advantage may be that the "hinged" feature of the folding lines allows the fully or partly removable tear-open parts to be repeatedly closed and reopened, further preserving the integrity of the content and preventing unnecessary contamination.

Advantageously the sealing disc comprises or consists of a first fully or partly removable tear-open part and a second fully or partly removable tear-open part. The first and second fully or partly removable tear-open parts may be of the same size but preferably the first fully or partly removable tear-open part is smaller than the second fully or partly removable tear-open part.

One of the advantages of providing a packaging container with a sealing disc comprising at least two fully or partly removable tear-open parts is that it provides an option for the consumer to only open a limited part of the seal at the time. By providing a sealing disc having fully or partly removable tear-open parts of different sizes the user may choose which size is suitable for the intended purpose of the container and its content. Sometimes a small access opening is required as only small and precise amounts are metered each time. Under different circumstances it may be required to access the content using spoons or scoops and a large access opening is necessary to be able to reach the content.

When tearing open a sealing disc provided with fully or partly removable tear-open parts of different sizes as disclosed herein the consumer may choose the size of the opening providing access to the content inside the packaging container as required. The user may choose to fold out or completely remove a small tear-open part to allow the contents of the container to be poured out of the container in a controlled manner, as set out herein. The user may then choose to remove a larger tear-open part, to create a large opening for scooping out contents. It may also be desirable to be able to expose a maximum-size access opening when emptying out the last contents of the packaging container.

In the simplest embodiment of the sealing disc as disclosed herein, the sealing disc comprises a first and a second fully or partly removable tear-open part. A first separating tear line extending between a pair of first and a second intersections arranged on the contour line delimits the first fully or partly removable tear-open part from the second fully or partly removable tear-open part. A first tear line extending along the contour line from the first intersection to the second intersection of the first pair of intersections delimits the first fully or partly removable tear-open part from the peripheral edge portion.

The first separating tear line extends in a direction perpendicular to the contour line from the first intersection point of a first pair of intersection points located on the contour line, and across the first surface of the sealing disc to a second intersection point of the first pair of intersection points located on the contour line and opposite to the first intersection point.

A second tear line extending along the contour line from the second intersection to the first intersection of the first pair of intersections delimits the second fully or partly removable tear-open part from the peripheral edge portion. When no hinge folding line or interruption points are provided on the first or second tear lines, both of the fully or partly removable tear-open parts can be fully removed from the sealing disc and provide a first or a second access opening in the sealing disc. If both of the first and second fully or partly removable tear-open parts are removed, one large access opening is formed providing full access to the content contained in the packaging container.

A first interruption point and a second interruption point of a pair of interruption points are arranged on either the first or the second tear line, with a hinge folding line arranged between the first and second interruption points. The hinge folding line prevents full removal of the fully or partly removable tear-open part from the sealing disc and enables the fully or partly removable tear-open part to be folded upwards and away from the first surface of the sealing disc and outwards from the peripheral edge portion of the sealing disc, thereby forming an access opening to the content of the packaging container. The fully or partly removable tear-open part remains attached to the peripheral edge portion of the sealing disc by means of the hinge folding line.

The hinged fully or partly removable tear-open part is advantageously provided with spout folding lines extending from the first and second interruption points to the first separating tear line on the second surface of the sealing disc. The spout folding lines enable the user to fold the outer portions of the hinged fully or partly removable tear-open part along the spout folding lines to form a pouring spout that may be used when pouring content unimpededly from the packaging container through the formed access opening.

One of the fully or partly removable tear-open parts may be provided with a tear-strip being part of said fully or partly removable tear-open part.

In this embodiment the tear line extends from a first intersection through a second intersection and to an end point. The first and second intersections are arranged on the contour line, and the end point is arranged within the fully or partly tear-open part. A first portion of the tear line extending between the first and second intersections along the contour line constitutes a contour section of said contour line, and a second portion of the tear line extending between the second intersection and the end point constitutes a tear-strip section, the tear-strip section delimiting said pull-tab and an inner edge of the tear strip.

A tear strip as disclosed herein can be used to tear open the sealing disc in a smooth, controlled and continuous tearing movement with reduced risk of fraying the peripheral edge portion or damaging the fully or partly tear-open part before it is removed completely from the sealing disc.

According to the present disclosure, both the first and the second fully or partly removable tear-open parts may be provided with a hinge folding lines. For example packaging containers having removable lids may advantageously be provided with sealing discs having fully or partly removable tear-open parts which both may be folded into pouring spouts. As disclosed herein, a fully or partly removable tear-open part which is provided with a hinge folding line may be configured to be folded back over the contents, after having been opened. This provides protection of the packaged contents in addition to an outer lid.

Therefore a third interruption point and a fourth interruption point may be arranged along a second tear line with a second hinge folding line arranged between the third and the fourth interruption points. The second hinge folding line prevents removal of the second fully or partly removable tear-open part and enables the second fully or partly removable tear-open part to be folded upwards and away from the first surface of the sealing disc and outwards from the peripheral edge portion of the sealing disc, thereby forming a second access opening to the content of the packaging container. The second fully or partly removable tear-open part remains attached to the peripheral edge portion of the sealing disc by means of the second hinge folding line.

The second fully or partly removable tear-open part may be provided with second spout folding lines extending from the third and fourth interruption points to the first separating tear line on the second surface of the sealing disc. The second spout folding lines enable the user to fold the edge portions of the second fully or partly removable tear-open part along the second spout folding lines to form a second pouring spout that may be used when pouring content unimpededly from the packaging container through the second access opening.

The sealing disc as disclosed herein may be provided with a section that remains in the sealing disc when both the first and second fully or partly removable tear-open parts have been partly or fully removed. The section that remains is advantageously arranged between the first and second fully or partly removable tear-open parts and will stabilize the shape of the container opening thereby facilitating repeated opening and tight closing of the container with a removable lid or a hinge lid.

The first separating tear line extends between a pair of first and second intersections and delimits the first fully or partly removable tear-open part from the section not to be removed, and a second separating tear line extends between a pair of third and fourth intersections arranged on the contour line delimits the second fully or partly removable tear-open part from the section not to be removed. The second separating tear line extends from the third intersection in a direction perpendicular to the contour line and across the first surface of the sealing disc to a fourth intersection arranged on the contour line opposite to the third intersection.

A first tear line extending along said contour line from the first intersection to the second intersection delimits the first fully or partly removable tear-open part from the peripheral edge portion, and a second tear line extending along said contour line from the third intersection to the fourth intersection delimits the second fully or partly removable tear-open part from said peripheral edge portion. When no hinge folding line or interruption points are provided on the first or second tear lines, both of the fully or partly removable tear-open parts can be fully removed from the sealing disc and provide a first and/or a second access opening in the sealing disc.

In a sealing disc as disclosed herein, one or both of the first and second fully or partly removable tear-open parts is provided with hinge folding lines to enable folding of the fully or partly removable tear-open parts upwards and away from the first surface of the sealing disc and outwards over the peripheral edge to form a re-closable access opening. In this case one or both of the fully or partly removable tear-open parts may also be provided with spout folding lines that will enable the user to form pouring spouts by means of which the content can be poured from the access openings.

A first interruption point and a second interruption point of a first pair of interruption points may be arranged on the first tear line with a first hinge folding line arranged between the first and second interruption points. The first hinge folding line prevents full removal of the first fully or partly removable tear-open part from the sealing disc and enables the first fully or partly removable tear-open part to be folded upwards and away from the first surface of the sealing disc and outwards and over the peripheral edge portion of the sealing disc. The first fully or partly removable tear-open part remains attached to the peripheral edge portion of the sealing disc by means of the first hinge folding line.

The first fully or partly removable tear-open part is advantageously provided with first spout folding lines extending from the first and second interruption points to the first separating tear line on the second surface of the sealing disc. The first spout folding lines enable the user to fold the edge portions of the first fully or partly removable tear-open part along the spout folding lines to form a first pouring spout that may be used when pouring content unimpededly from the packaging container through the first access opening.

A third interruption point and a fourth interruption point may be arranged along the second tear line with a second hinge folding line arranged between the third and the fourth interruption points. The second hinge folding line prevents removal of the second fully or partly removable tear-open part and enables the second fully or partly removable tear-open part to be folded upwards and away from the first surface of the sealing disc and outwards across the peripheral edge portion of the sealing disc. The second fully or partly removable tear-open part remains attached to the peripheral edge portion of the sealing disc by means of the second hinge folding line.

The second fully or partly removable tear-open part is advantageously provided with second spout folding lines extending from the third and fourth interruption points to the second separating tear line on the second surface of the sealing disc. The second spout folding lines enable the user to fold the edge portions of the second fully or partly removable tear-open part along the second spout folding lines to form a second pouring spout that may be used when pouring content unimpededly from the packaging container through the second access opening.

The sealing disc may be made from any suitable material or material combination as known in the art, such as paper board, aluminum foil, silicon-coated paper, plastic film or any useful combination thereof. In some instances, a paperboard sealing disc may be preferred as it may eliminate the need for using shape stabilizing plastic components such as a plastic upper edge rim.

In a sealing disc, tear lines are generally formed from the surface of the sealing disc which will be facing a user when opening a packaging container provided with the sealing disc. However, in sealing discs where the tear-open parts are fully or partly removed by pushing the part into the container, a combination of tear-lines being made from the outer surface and tear lines being made from the inner surface may be used. In all instances, it should generally be ascertained that all cuts and tear lines are made without creating through-going passages in the sealing disc, in order to maintain the sealing capacity of the sealing disc. Tear lines in a paperboard sealing disc are generally made by cuts partially through the thickness of the paperboard material. Another common type of sealing discs is made from a laminate of an upper and a lower layer each comprising a metal foil, such as aluminum foil and a plastic film layer. In such sealing discs, the tear lines are commonly made only in the upper layer and the layers are connected in a manner such that when tearing along the tear lines in the upper layer, the lower layer is also broken along the tear lines.

Also disclosed herein is a packaging container comprising the sealing disc as described herein. The packaging container comprises a container body comprising a container wall extending from a container bottom to a container opening, and a closure arrangement comprising a lid, a peripheral edge portion of the sealing disc being attached to an inner surface of the container wall, the sealing disc forming a transport seal across the container opening.

The packaging container is preferably a paperboard packaging container, as defined herein.

The sealing disc may form a container lid, without an additional outer lid being provided. However, advantageously the packaging container comprises a container lid in addition to the sealing disc and the sealing disc is provided as a transport closure attached to the inner surface of the packaging container.

When opening a packaging container as disclosed herein for a first time, a user first opens the lid to expose the sealing disc which is attached to the container wall. Thereafter the user removes one or more of the fully or partly removable tear-open parts.

As used herein, a paperboard packaging container is a packaging container wherein the container body is formed from paperboard sheet material. The paperboard container may be formed in any manner known in the art, e.g. by forming a container body by bending a paperboard sheet material into a tubular shape and longitudinally closing the tube by joining overlapping or abutting side edges of the paperboard material. The join between the side edges may be covered by a sealing strip. The body tube may be formed into any desired tubular shape including circular, oval, polygonal and modified polygonal shapes, such as the modified rectangular shape with rounded corners which is shown in the figures. One or more side wall of a container body having a modified polygonal shape may have a slight outward curvature to increase shape stability and grippability of the paperboard container. Likewise, the sealing discs as disclosed herein may have any suitable shape, as needed depending on the shape of the paperboard packaging container.

In the paperboard packaging containers as disclosed herein, the container bottom may be formed from a separate bottom disc which is attached at the bottom end of the container body tube. The bottom disc may be attached on the inside of the container body tube and may be inset from the container body bottom edge to accommodate a bottom reinforcing rim attached to the inner surface of the container body or to allow the end edge of the container body to be folded inwards to form a curled bottom edge. A further alternative is to form the container bottom by folded-in portions of the container body material.

As used herein, a paperboard material is a sheet material predominantly made from cellulose fibres or paper fibres. The sheet material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

As used herein, the term "bulk solids" refers to a solid bulk material from which a desired amount of the product may be poured, scooped or taken by hand out of a packaging container. The bulk material may be dry or moist. The bulk solids which are suitable for packing in the paperboard packaging containers as disclosed herein include any material in the form of particles, granules, grinds, plant fragments, short fibres, flakes, seeds, pieces, etc.

The paperboard packaging container as disclosed herein may be a container for alimentary products such as infant formula, coffee, tea, rice, flour, sugar, cereals, soup powder, custard powder, pasta, snacks, or the like. Alternatively, the bulk solids may be non-alimentary, such as tobacco, detergent, fertilizer, chemicals or the like.

The tearable sealing disc as disclosed herein may be gastight or gas-permeable. A gastight sealing disc may comprise a structural layer made from any material or material combination suitable for providing a gastight sealing of a compartment delimited by the sealing disc, such as aluminium foil, silicon-coated paper, plastic film, etc. A gastight sealing disc is advantageous when the bulk solids stored in the packaging container are sensitive to air and/or moisture and it is desirable to avoid contact of the packaged bulk solids with ambient air.

The barrier properties of the packaging containers disclosed herein may be designed to meet different requirements of tightness depending on the goods which is packaged in the packaging container. By way of example, in a packaging container for dried peas a lower barrier level may be sufficient than in a packaging container for e.g. infant formula which is highly sensitive to oxygen and moisture exposure.

A gastight packaging container is particularly advantageous when the material stored in the packaging container is sensitive to air and/or moisture. It may also be desirable to keep fragrances and aromas in the packaging container and prevent the packaged contents from taking up scents and flavours from the ambient air. In case the packaging container has been filled in a protective gas atmosphere, the gas-tight sealing disc keeps the protective gas trapped together with the packaged contents in the sealed inner compartment.

When opening a packaging container which is sealed by a sealing disc as disclosed herein, the fully or partly removable tear-open part of the sealing disc is removed by pulling at the grip-end of the pull-tab and tearing along the tear line or separating tear line delimiting the fully or partly removable tear-open part.

DETAILED DESCRIPTION

It is to be understood that the drawings are schematic and that individual components are not necessarily drawn to scale. The packaging container and the sealing disc shown in the figures are provided as examples only and should not be considered limiting to the invention as disclosed herein. In particular, it should be understood that the sealing disc as disclosed herein may be applied to any packaging container where a breakable transport seal is desired in addition to the provision of a reclosable lid. Furthermore, the size and shape of the packaging container and a corresponding sealing disc may be different from what is shown in the figures. The tear-open parts may have a different sizes and shapes, and may have a differently shaped pull-tab portion or may be provided with other opening means than a pull-tab or no particular opening means at all, as set out herein.

Figure 1A:
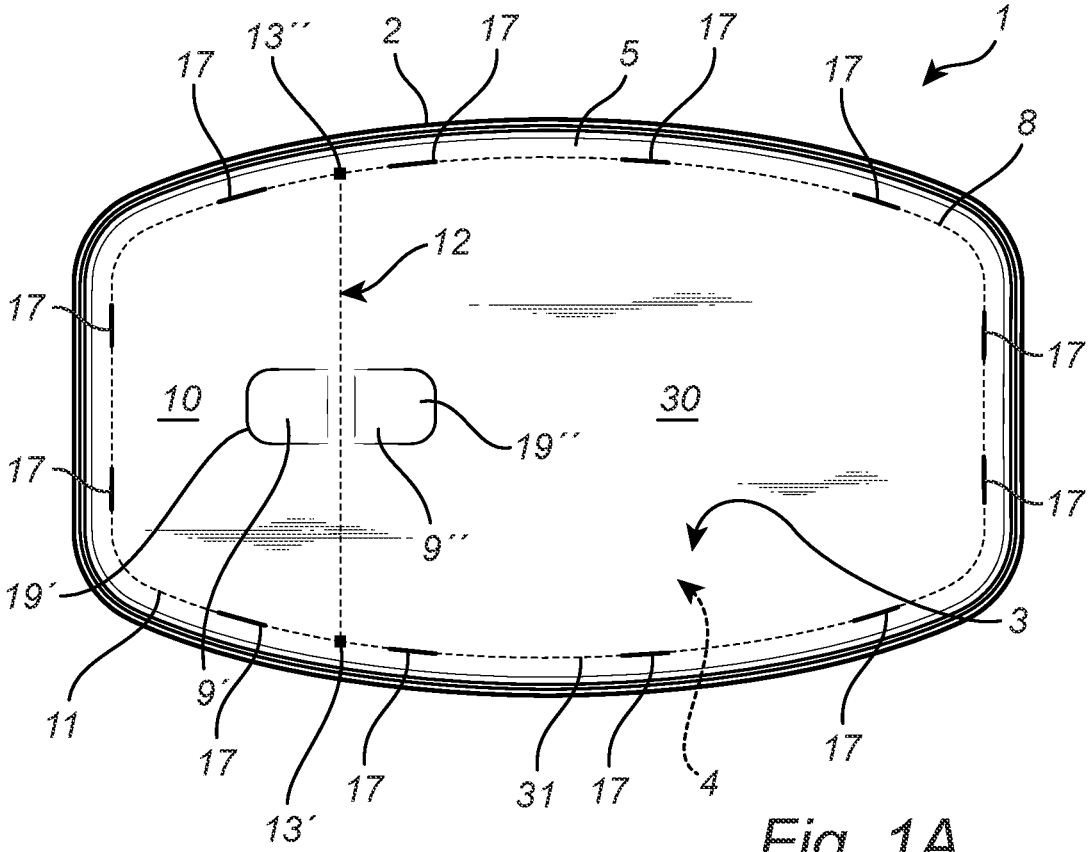
FIGS. 1A and 1B show a top view of a sealing disc comprising two fully or partly removable tear-open parts, wherein in FIG. 1B one fully or partly removable tear-open part has been removed.

FIG. 1A discloses a sealing disc 1 for sealing an inner compartment in a packaging container 100. The sealing disc 1 has a first surface 3 and a second surface 4 and is delimited by a sealing disc outer edge 2. When mounted in a packaging container 100 the first surface 3 of the sealing disc 1 faces towards the opening and the lid 114 of the packaging container 100, and the second surface 4 faces the interior and the bulk goods inside the packaging container 100 as shown in FIGS. 5A to 5H.

The sealing disc 1 comprises at least two fully or partly removable tear-open parts 10, 30 which are delimited by a contour line 8 surrounded by a peripheral edge portion 5. The sealing disc normally has the same shape as the contour of the inner walls of the container it is supposed to seal and when inserted into a packaging container 100 the peripheral edge portion 5 of the sealing disc is attached to the inner surface of the container wall e.g. by welding. The sealing disc may alternatively be attached to a reinforcing rim of the packaging container (not shown) or to a top edge, such as a curled top edge of the packaging container, as known in the art.

Upon removal of one or more of the fully or partly removable tear-open parts 10, 30, the peripheral edge portion 5 of the sealing disc 1 remains attached to the inner side of the container wall 103. The remaining peripheral edge portion 5 may contribute to stabilizing the container opening 105. Any such remaining part of the sealing disc 1 is preferably as small as possible, in order not to encroach on the opening area. It may be preferred that a remaining sealing disc edge part has a width of at most 7 millimeters such as from 1-6 millimeters, from 2-5 millimeters or from 3-4 millimeters. It may be preferred that the inward extension of a remaining sealing disc part is 4 millimeters or less.

The sealing disc 1 may contain more than two fully or partly removable tear-open parts, but ideally it contains only two fully or partly removable tear-open parts 10, 30 as seen in figures herein. Each one of the fully or partly removable tear-open parts 10, 30 is configured to be fully or partly separated from said peripheral edge portion 5 along the contour line 8.

In order to facilitate the full or part removal of the fully or partly removable tear-open parts 10, 30 arranged in the sealing disc 1, at least one of the fully or partly removable tear-open parts 10, 30 is provided with an opening arrangement such as e.g. pull-tabs, grip-tabs, opening rings, etc. Advantageously the end edge 19', 19" of a pull-tab is exposed from the fully or partly removable tear-open part to facilitate gripping and lifting of the pull-tab. Both of the fully or partly removable tear-open parts 10, 30 may be provided with an opening arrangement 9', 9".

Figure 3D:
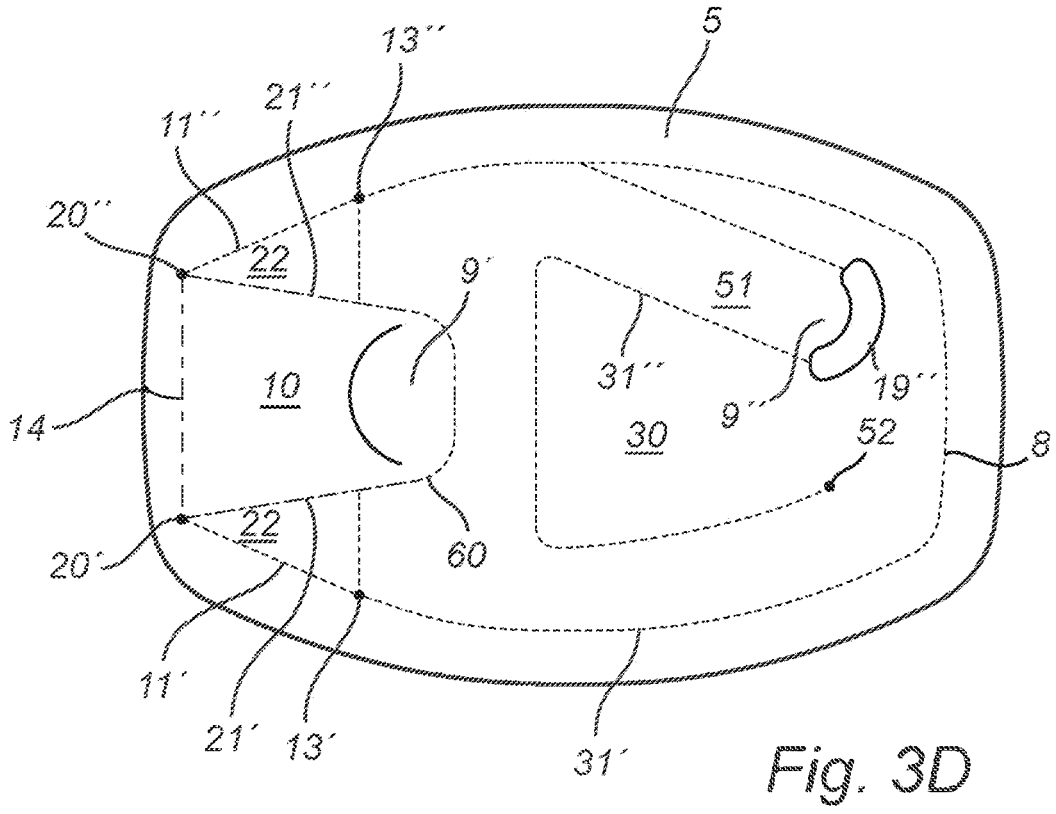
Figure 4A:
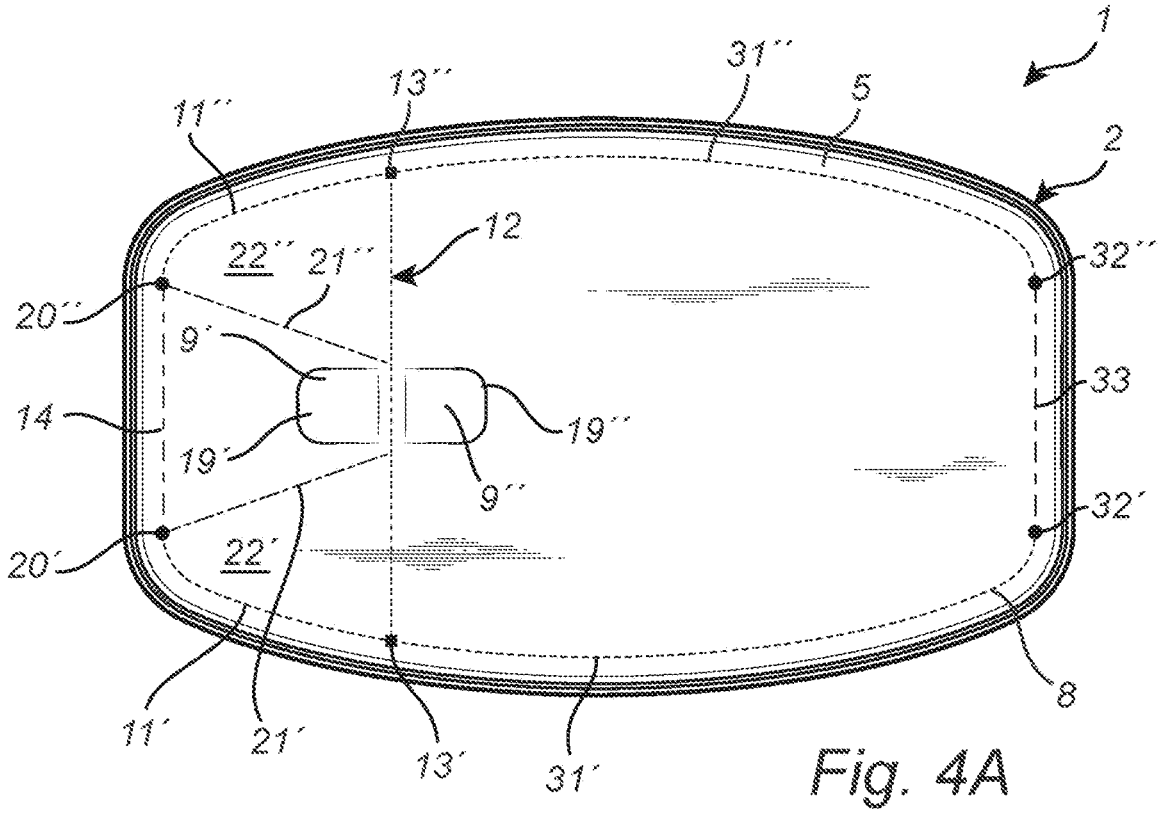
FIGS. 4A-4C show different embodiments of sealing discs wherein both fully or partly removable tear-open part are provided with hinge folding lines.
Figure 4B:
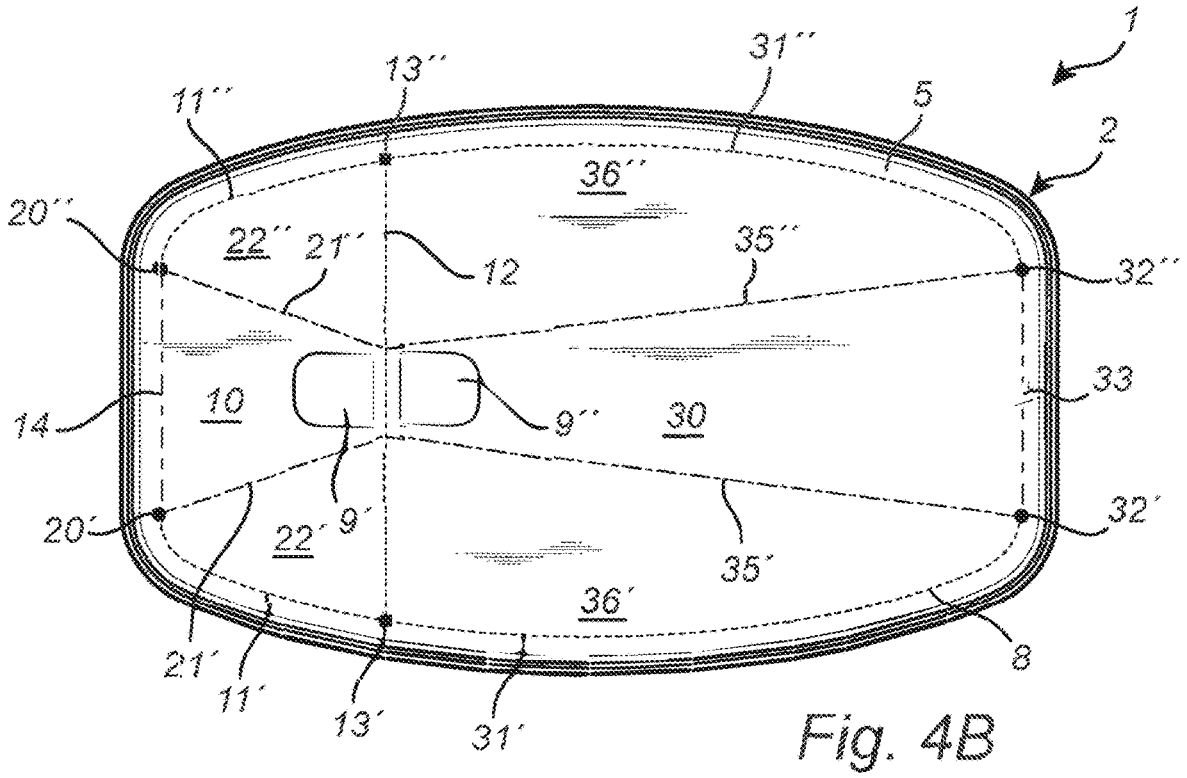
Figure 4C:
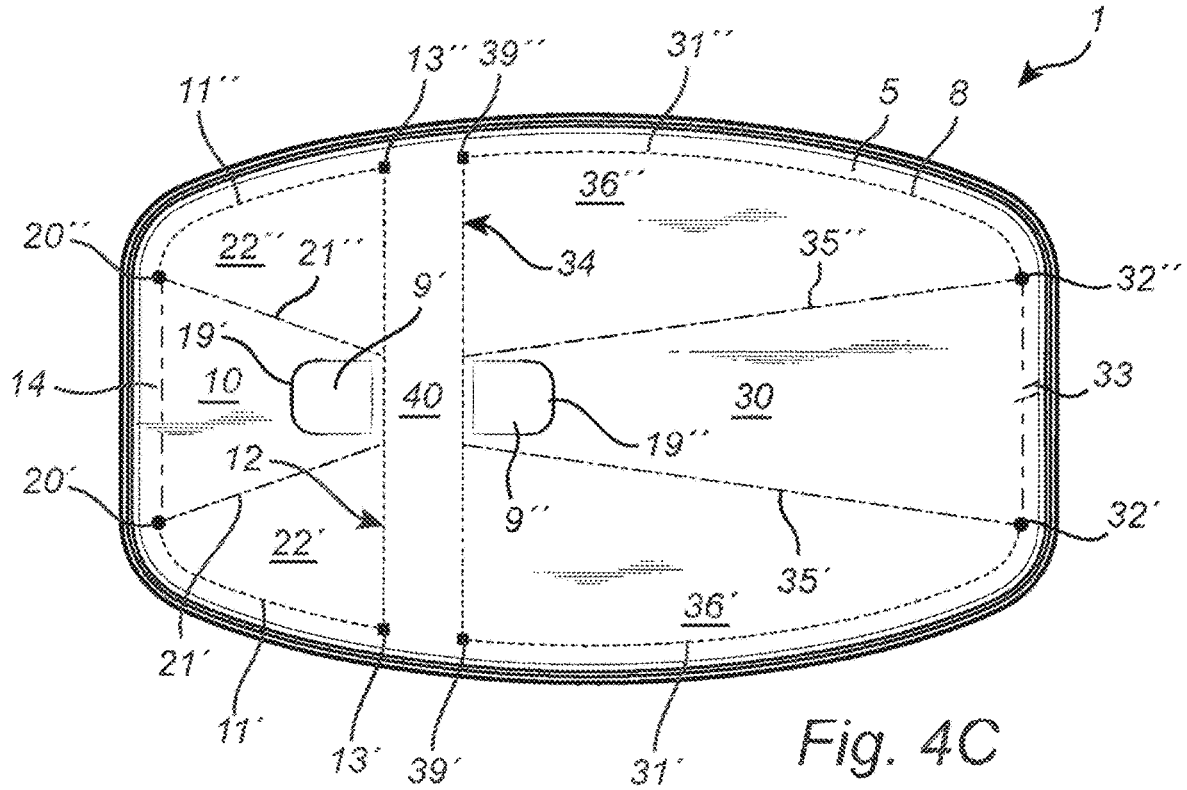

The sealing disc 1 is provided with one or more separating tear lines 12, 34 which delimit the fully or partly removable tear-open parts 10, 30 from each other or from sections 40 of the sealing disc 1 not intended to be removed (see e.g. FIG. 4C). The separating tear lines 12, 34 extend perpendicularly from a first intersection 13', 39' of a pair of intersections arranged on the contour line 8 and across the first surface 3 of the sealing disc 1 to a second intersection 13", 39" of the pair of intersections arranged on the contour line 8 and opposite to the first intersection 13', 39'. The separating tear lines 12, 34 in the FIGS. herein extend in a straight line across the sealing disc. However, the separating tear lines 12, 34 may also extend in a curved line 60 across the sealing disc or may have any other suitable shape, as set out herein (see e.g. FIG. 3D).

One or more tear lines 11, 31 are arranged along the contour line 8. As seen in the figures the tear lines 11, 31 may fully or partly delimit said fully or partly removable tear-open parts 10, 30 from said peripheral edge portion 5. The tear lines 11, 31 are intersected by one or more separating tear lines 12, 34 extending between intersections of the one or more pairs of intersections 13', 13", 39', 39" arranged on the contour line 8.

At intersections 13', 13", 39', 39" one or more tear lines 11, 11', 11", 31, 31', 31" arranged along the contour line 8 intersect with a separating tear line 12, 34 extending across the sealing disc between pairs of intersections 13', 13", 39', 39", and during the tearing of the fully or partly removable tear-open parts 10, 30 the tearing action along the tear lines 11, 11', 11", 31, 31', 31" and separating tear lines 12, 34 is discontinued when reaching an intersection 13', 13", 39', 39".

The tear lines 11, 31 may also be interrupted by one or more hinge folding lines 14, 33 extending between pairs of interruption points 20', 20", 32', 32" arranged on the contour line 8. The hinge folding lines 14, 33 delimit one or more of the fully or partly removable tear-open parts 10, 30 from the peripheral edge portion 5 and prevent full removal of the fully or partly removable tear-open parts 10, 30 from the sealing disc 1. When tearing the fully or partly removable tear-open parts 10, 30 along the tear lines 11', 11", 31', 31" the tearing action will be interrupted when reaching one of the interruption points 20', 20", 32', 32" arranged on either side of hinge folding lines 14, 33.

Hinge folding lines 14, 33 (see e.g. FIGS. 2A and 2B) will enable the fully or partly removable tear-open parts 10, 30 to be folded upwards from the sealing disc first surface 3 and outwards over the peripheral edge portion 5 of the sealing disc 1 to be used as pouring spouts as described below. Due to the "hinged" feature of the folding lines 14, 33 the fully or partly removable tear-open parts 10, 30 can be repeatedly closed and reopened. However, it is contemplated that the hinge folding lines 14, 33 may be provided with a partially cut tear line which is stronger than the separating tear lines and the tear lines delimiting the fully or partly removable tear-open parts 10, 30 from the peripheral edge portion, but which will tear if sufficient tearing force is applied.

As set out herein, the tear lines 11, 31 and the separating tear lines 12, 34 may be formed as continuous cuts, or may be formed as intermittent cuts with one or more un-cut tabs 17 between cut sections, as illustrated in FIG. 1A. Such uncut tabs 17 in the first and second tear lines 11, 31 may have a length of at most 2 millimetres, preferably at most 1 millimetre. The uncut tabs 17 serve to stabilize the sealing disc 1 and make it easier to handle in a production process when applying sealing discs 1 to packaging containers 100. The number and locations of the un-cut tabs 17 as shown in the figures are only intended as examples and it is to be understood that fewer or more un-cut tabs 17 could be provided, and that an un-cut tab 17 may be arranged at any desirable location along the tear lines 11, 31.

The tear lines 11, 31 and the separating tear lines 12, 34 are cut into the sealing disc 1 from the first surface 3. The tear lines 11, 31 and the separating tear lines 12, 34 extend into the sealing disc 1 by a cutting depth of from 15-80% of the sealing disc 1 thickness.

The sealing disc 1 may comprise two or more fully or partly removable tear-open parts 10, 30, but advantageously it only consists of a first fully or partly removable tear-open part 10 and a second fully or partly removable tear-open part 30. The first and second fully or partly removable tear-open parts 10, 30 may have the same size, but advantageously they are of different sizes and the first fully or partly removable tear-open part 10 is smaller than the second fully or partly removable tear-open part 30 as can be seen in the figures herein.

The proportion of the surface area for the first fully or partly removable tear-open part 10 in relation to the surface area of the second fully or partly removable tear-open part 30 is less than 1:1 such as 1:2-1:9, or 1:2-1:8, or 1:3-1:7, or 1:4-1:6.

FIG. 1A discloses one embodiment of a sealing disc 1 having a first and a second fully or partly removable tear-open part 10, 30 wherein the first fully or partly removable tear-open part 10 is smaller than the second fully or partly removable tear-open part 30.

A first separating tear line 12 extends between a pair of first and second intersections 13', 13" arranged on the contour line 8 delimiting said first fully or partly removable tear-open part 10 from said second fully or partly removable tear-open part 30. The first separating tear line 12 extends from the first intersection 13' in a direction perpendicular to the contour line 8 and across the first surface 3 of the sealing disc 1 to the second intersection 13" arranged on the contour line 8 opposite to the first intersection 13' (see the separating tear line 12 in FIG. 1A).

A first tear line 11 extending along said contour line 8 from the first intersection 13' to the second intersection 13" fully delimits the first fully or partly removable tear-open part 10 from the peripheral edge portion 8, and a second tear line 31 extends along the contour line 8 between the second and first intersections 13", 13' delimiting the second fully or partly removable tear-open part 30 from the peripheral edge portion 5. In this embodiment there are no hinge folding lines arranged on any of the tear lines and therefore the first or second fully or partly removable tear-open part 10, 30 will be completely removed from the sealing disc 1 when a user pulls the pull-tabs 9', 9" provided on the fully or partly removable tear-open part 10, 30.

Figure 1B:
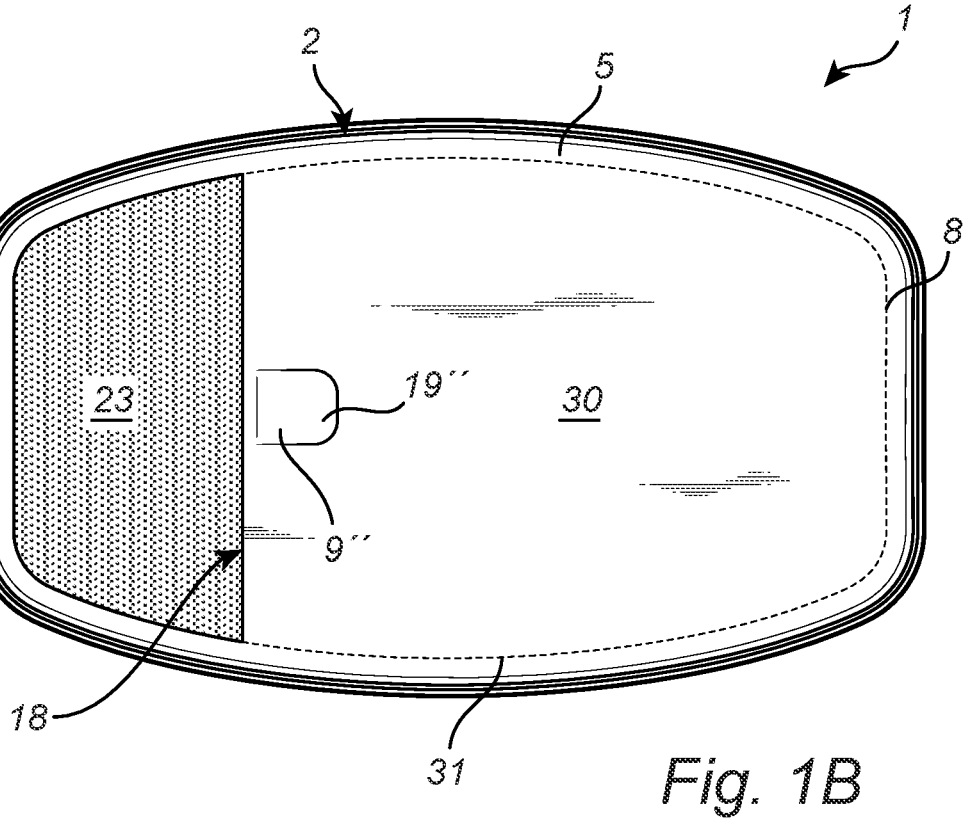

The consumer may here choose whether to remove only the first or both of the first and second fully or partly removable tear-open parts 10, 30. FIG. 1B discloses a sealing disc 1 wherein the first fully or partly removable tear-open part 10 has been removed and the second fully or partly removable tear-open part 30 remains. If full access to the interior of the packaging container 100 is required, the remaining second fully or partly removable tear-open part 30 is easily removed from the sealing disc 1 by gripping the torn edge 18 of the first separating tear line 12 and tearing the remaining second fully or partly removable tear-open part 30 away from the peripheral edge portion 5 along the remaining tear line 31. Alternatively, if the second fully or partly removable tear-open part 30 is provided with an opening arrangement, the user may also use e.g. a pull-tab 9" to remove the remaining second fully or partly removable tear-open part 30 from the sealing disc 1.

Figure 2A:
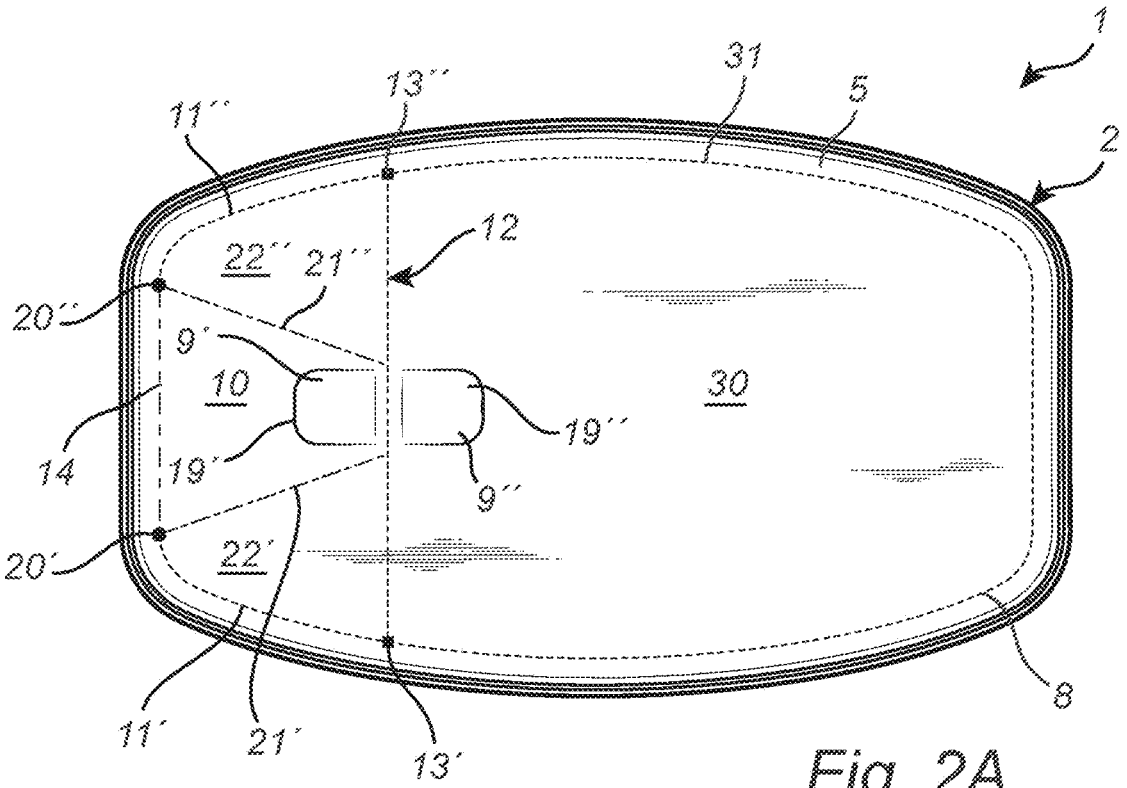
FIGS. 2A and 2B show two different embodiments of sealing discs wherein the first fully or partly removable tear-open part comprises hinge folding lines and spout folding lines.

FIG. 2A discloses a sealing disc 1 wherein the first tear line 11 delimiting the first fully or partly removable tear-open part 10 is provided with a first pair of first and second interruption points 20', 20" with a first hinge folding line 14 arranged therebetween. The first hinged folding line 14 prevents complete removal of the first fully or partly removable tear-open part 10 and instead the first fully or partly removable tear-open part 10 remains attached to the peripheral edge portion 5 between the first pair of interruption points 20', 20".

In order to open the first fully or partly removable tear-open part 10 the user grabs and pulls the opening arrangement 9' arranged on the first fully or partly removable tear-open part 10 upwards and away from the first surface 3 of the sealing disc 1. A tear is propagated along the first separating tear line 12 between the first and second intersections 13', 13" creating a separation between the first and second fully or partly removable tear-open parts 10, 30. When the tear reaches the first and second intersections 13', 13" it is interrupted and thereafter the tearing action continues along first and second portions 11', 11" of the first tear line, separating the first fully or partly removable tear-open part 10 from the peripheral edge portion 5 until the tear reaches the first and second interruption points 20', 20".

The first portion 11' of the first tear line extends along the contour line 8 between the first intersection 13' and the first interruption point 20', and the second portion 11" of the first tear line extends along the contour line 8 between the second intersection 13" and the second interruption point 20" (see FIG. 2A). Thus the entire first fully or partly removable tear-open part 10, except for the part constituting the first hinged folding line 14 extending between the first and second interruption points 20', 20" has been separated from the sealing disc 1 and can be folded outwards to enable access to the content inside the packaging container 100 through a first access opening 23.

Advantageously the first fully or partly removable tear-open part 10 is provided with first spout folding lines 21', 21" extending from the first and second interruption points 20', 20" to the first separating tear line 12 (see FIG. 2A). The spout folding lines 21', 21" are arranged on the second surface 4 of the sealing disc 1 (i.e. the side facing the interior of the packaging container 100), and when the first fully or partly removable tear-open part 10 is folded outwards, outer edge portions 22', 22" of the first fully or partly removable tear-open part 10 may be folded along the first spout folding lines 21', 21" to form a first pouring spout 15 (see FIGS. 5D and 5E).

The sealing disc 1 disclosed in FIG. 2A is advantageous when the consumer desires to retain a major part of the sealing disc 1 in order to prevent contamination of the content stored in the packaging container. A smaller access opening provided with a pouring spout 15 will facilitate and improve the preciseness of the pouring action for the user while simultaneously protecting the content stored in the packaging container from exposure to the environment.

In case a larger access opening is required, also the second fully or partly removable tear-open part 30 may be removed completely in a similar manner as described for the embodiment in FIG. 1B above.

Figure 2B:
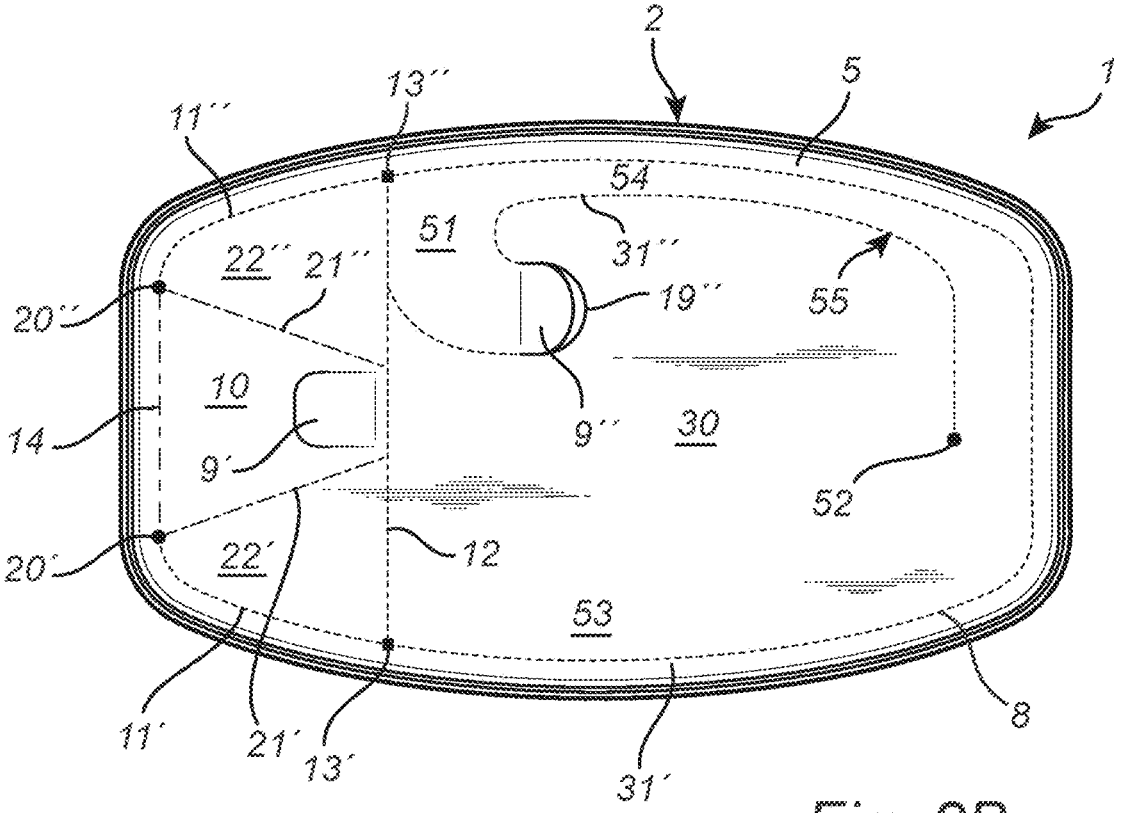

An advantageous embodiment of the sealing disc 1 is shown in FIG. 2B wherein the second fully or partly removable tear-open part 30 is provided with a tear-strip 51 being part of the second fully or partly removable tear-open part 30.

In this embodiment the second tear line 31 extends from the first intersection 13' through a second intersection 13" and to an end point 52. The first and second intersections 13', 13" are arranged on the contour line 8, and the end point 52 is arranged within the second fully or partly tear-open part 30. A first portion 31' of the second tear line extends between the first intersection 13' and the second intersection 13" along the contour line 8 and constitutes a contour section 53 of the contour line 8. A second portion 31" of the second tear line extending between the second intersection 13" and the end point 52 constitutes a tear-strip section 54. The tear-strip section 54 delimits the pull-tab 9'" and an inner edge 55 of the tear strip 51.

When tearing open a sealing disc provided with a tear-strip 51 being part of the second fully or partly removable tear-open part 30 as disclosed herein, the pulling may be made in a smooth and controlled continuous tearing movement.

Figure 3A:
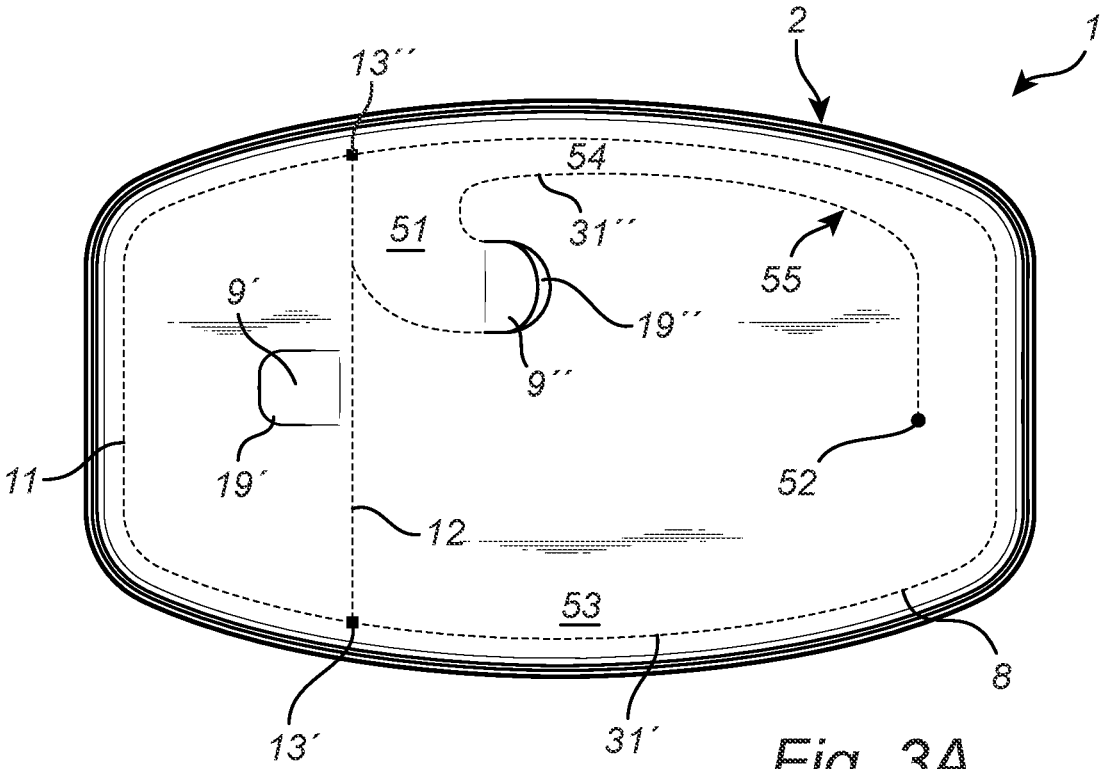
FIGS. 3A-3D show different embodiments of sealing discs comprising a fully or partly removable tear-open part provided with a tear strip.
Figure 3B:
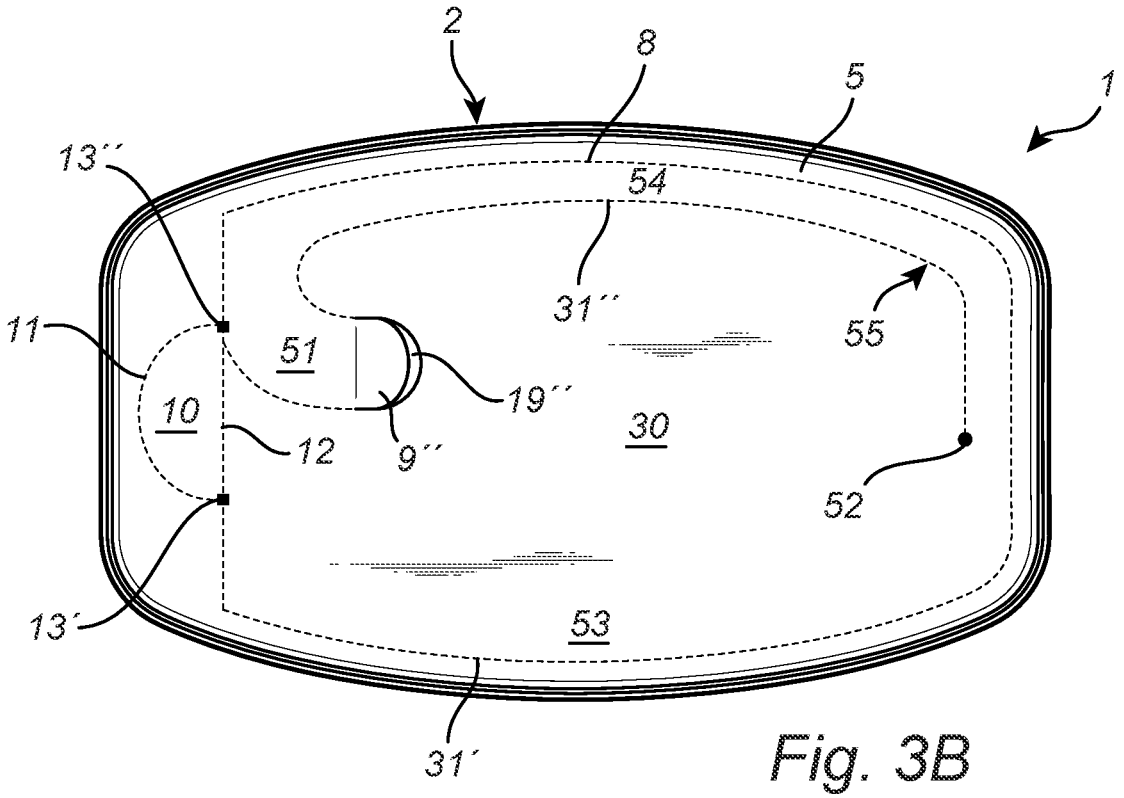
Figure 3C:
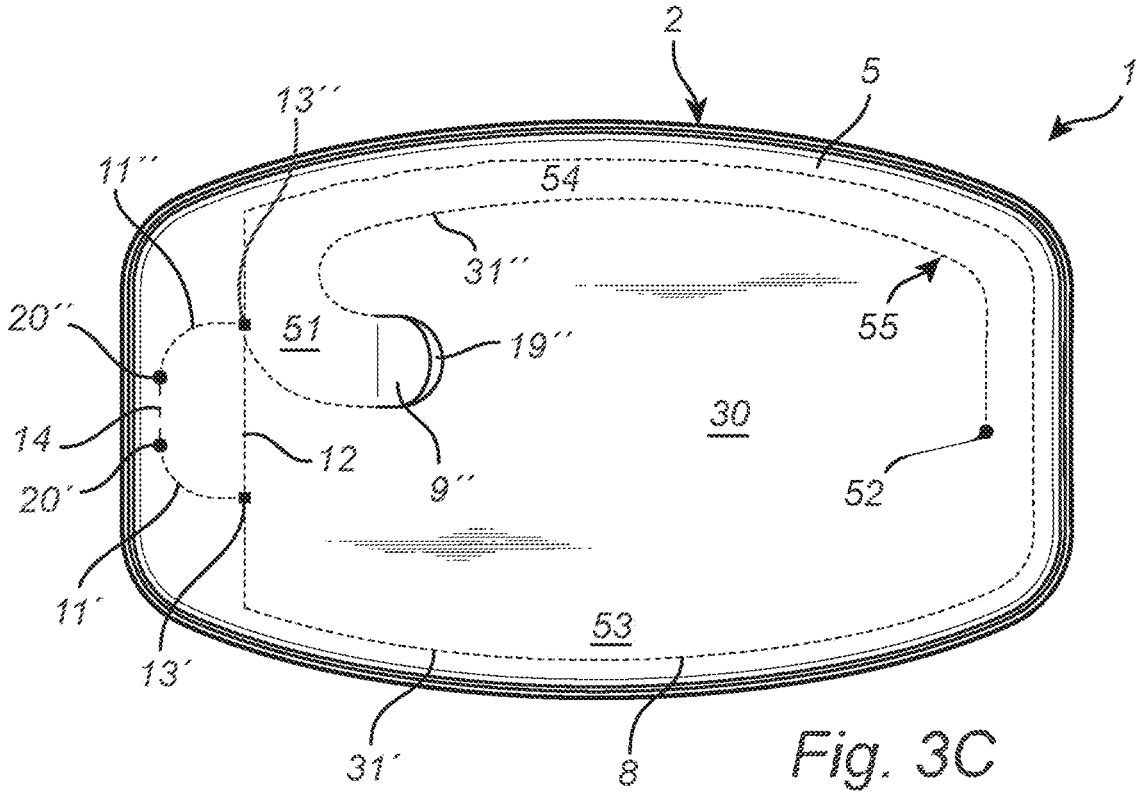

FIGS. 3A-3D disclose alternative advantageous embodiments of the sealing disc 1 shown in FIG. 2B. FIG. 3A discloses a sealing disc 1 wherein the first fully or partly removable tear-open part 10 has no hinge folding line. Thus, the first fully or partly removable tear-open part 10 can be removed completely from the sealing disc 1, and optionally the second fully or partly removable tear-open part 30 can be removed by pulling the tear strip 51.

FIGS. 3B and 3C disclose sealing discs 1 wherein the first fully or partly removable tear-open parts 10 are very small. Here the first fully or partly removable tear-open part 10 function as a push-tab and is preferably opened by pressing the first fully or partly removable tear-open part 10 downwards and into the packaging container. This embodiment is advantageous when the user wants to open a very small access opening in the sealing disc 1. The first fully or partly removable tear-open part 10 of the sealing disc 1 shown in FIG. 3C is provided with a first hinge folding line 14 and therefore also provides the possibility to close the access opening in the sealing disc 1 after use to further improve the protection against contamination.

FIG. 3D discloses an alternative sealing disc 1 wherein a section of the first fully or partly removable tear-open part 10 comprising the pull-tab 9' protrudes into the second fully or partly removable tear-open part 30. The second fully or partly removable tear-open part 30 is provided with a similar tear strip 51 as disclosed in FIG. 2B, 3A-3C. In this embodiment the separation tear line 60 extending between first and second intersection points curves around the protruding section of the first fully or partly removable tear-open part 10.

Advantageously the first fully or partly removable tear-open part 10 is provided with first spout folding lines 21', 21" extending from the first and second interruption points 20', 20" to the curved separating tear line 60 on either side of the protruding section with the pull tab 9' (see FIG. 3D). The spout folding lines 21', 21" are arranged on the second surface 4 of the sealing disc 1 (i.e. the side facing the interior of the packaging container 100), and when the first fully or partly removable tear-open part 10 is folded outwards, outer edge portions 22', 22" of the first fully or partly removable tear-open part 10 may be folded along the first spout folding lines 21', 21" to form a pouring spout 15.

The second fully or partly removable tear-open part 30 may be removed by pulling the tear strip 51 as described above for the sealing disc 1 in FIG. 2B.

For all sealing discs 1 in FIGS. 3A-3D the second fully or partly removable tear-open parts 30 are opened or removed by tearing the tear strip 51. The tear strip 51 is optional and the second fully or partly removable tear-open part 30 in the sealing discs 1 of FIGS. 3A-3D may alternatively be opened or removed by gripping the edge formed along the separating tear line 12, 60 between the first and second fully or partly removable tear open parts 10, 30 after the first fully or partly removable tear-open part 10 has been opened or removed.

In the sealing discs 1 shown in FIGS. 3B and 3C, the first push-in tear open part 10 may be used as a grip member for pulling away the second fully or partly removable tear-open part 30. In such embodiments, no first hinge folding line 14 as shown in FIG. 3C is provided and instead the first fully or partly removable tear-open part 10 is provided with a hinge folding line on the separating tear line 12 in a position generally opposite the first hinge folding line 14 as shown in FIG. 3C and between the first and second intersections 13', 13" which are arranged on the separating tear line 12.

When using a first fully or partly removable tear-open part 10 as an opening or removal member for a second fully or partly removable tear-open part 30, the first fully or partly removable tear-open part 10 is pushed into the interior of the container body and folded in under the second fully or partly removable tear-open part 30 while staying attached to the second fully or partly removable tear-open part 30 along the hinge folding line connecting the first fully or partly removable tear-open part 10 with the second fully or partly removable tear-open part 30. In this manner, the first fully or partly removable tear-open part 10 forms a grippable reinforcement of the edge formed along the separating tear line 12 between the first and second fully or partly removable tear open parts 10, 30 after the first fully or partly removable tear-open part 10 has been opened.

FIGS. 4A-4C disclose sealing discs 1 which are especially suitable for packaging containers provided with removable lids. In these embodiments both the first and the second fully or partly removable tear-open parts 10, 30 are provided with hinge folding lines 14, 33 arranged on the tear lines 11, 31.

In a first embodiment shown in FIG. 4A a second pair of third and fourth interruption points 32', 32" are arranged along said second tear line 31 with a second hinge folding line 33 arranged between the third and the fourth interruption points 32', 32".

Here the user may choose, depending on the intended use, to open either the first or the second fully or partly removable tear-open part 10, 30 first. Both the first and the second fully or partly removable tear-open parts 10, 30 are in this embodiment provided with opening arrangements 9', 9", and if it is decided that the second fully or partly removable tear-open part 30 is to be opened first, the user will grab the opening arrangement 9" (a pull-tab as seen in FIG. 4A) arranged on the second fully or partly removable tear-open part 30, and start tearing the second fully or partly removable tear-open part 30 from the sealing disc 1.

The tearing action starts along the first separating tear line 12 in the direction towards the first and second intersections 13', 13" arranged on the contour line 8. When the tear reaches the first and second intersections 13', 13" it is interrupted and thereafter the tearing action continues along first and second portions 31', 31" of the second tear line, separating the second fully or partly removable tear-open part 30 from the peripheral edge portion 5 until the tears reach the third and the fourth interruption points 32', 32".

The first portion 31' of the second tear line extends along the contour line 8 between the first intersection 13' and the third interruption point 32' and the second portion 31" of the second tear line extends along the contour line 8 between the second intersection 13" and a fourth interruption point 32". Thus, the entire first fully or partly removable tear-open part 30 except the portion constituting the second hinged folding line 33 extending between the third and fourth interruption points 32', 32" may be separated from the sealing disc 1 and can be folded outwards to enable access to the content inside the packaging container 100 through a second access opening 34.

Advantageously, also the second fully or partly removable tear-open part 30 is provided with second spout folding lines 35', 35" extending from the third and fourth interruption points 32', 32" to the first separating tear line 12 (see FIG. 4B). The second spout folding lines 35', 35" are arranged on the second surface 4 of the sealing disc 1 and when the second fully or partly removable tear-open part 30 is folded outwards, outer portions 36', 36' of the second fully or partly removable tear-open part 30 may be folded along the second spout folding lines 35', 35" to form a second pouring spout (not shown).

In a further embodiment disclosed in FIG. 4C, the sealing disc 1 may contain two fully or partly removable tear-open parts 10, 30 wherein a section 40 not intended to be removed from the sealing disc 1 is arranged between the first and second fully or partly removable tear-open parts 10, 30. The section 40 intended to remain is not provided with any tear lines along the sealing disc contour line 8 and will thus remain attached to the peripheral edge portion 5 after both of the first and second fully or partly removable tear-open parts 10, 30 have been fully or partly removed from the sealing disc 1. The remaining section 40 may provide improved stability to the container opening.

The section 40 intended to remain is delimited from the first fully or partly removable tear-open part 10 by the first separating tear line 12, and from the second fully or partly removable tear-open part 30 by a second separating tear line 34 extending between a second pair of third and fourth intersections 39', 39" arranged on the contour line 8. The second separating tear line 34 extends from the third intersection 39' in a direction perpendicular to the contour line 8 and across the first surface 3 of the sealing disc 1 to a fourth intersection 39" arranged on the contour line 8 opposite to the third intersection 39' (see FIG. 4C).

In this embodiment one or both of the first and second fully or partly removable tear-open parts, 10, 30 may be provided with hinge folding lines 14, 33 as described above, which will enable the user to fold the fully or partly removable tear-open parts outwards to enable access to the container through an access opening. Advantageously the first and/or second fully or partly removable tear-open parts, 10, 30 are also provided with spout folding lines 21', 21", 35', 35" to enable the user form pouring spouts 15 which will facilitate pouring content from the container through the access openings 23.

Both of the tear-open parts 10, 30 are advantageously provided with opening arrangements 9', 9" and the user may thereby choose which one of the first and second fully or partly removable tear-open parts 10, 30 to remove first.

The first fully or partly removable tear-open part 10 may be fully or partly removed from the sealing disc 1 as follows:

The tearing action starts by gripping and pulling the opening arrangement 9' provided on the first fully or partly removable tear-open part 10, thereby separating the first fully or partly removable tear-open part 10 from the section 40 to remain along the first separating tear line 12 between the third and fourth intersections 13', 13" arranged on the contour line 8. When the tear reaches the first and second intersections 13', 13" it is interrupted and is thereafter continued along the first tear line 11 until the entire first fully or partly removable tear-open part 10 is separated from the peripheral edge portion 5 and can be removed from the sealing disc 1.

However, if the first fully or partly removable tear-open part 10 is provided with a hinge folding line 14, the tearing action starts by separating the first fully or partly removable tear-open part 10 from the section 40 to remain along the first separating tear line 12, and thereafter it will continue along first and second portions 11', 11" of the first tear line, separating the first fully or partly removable tear-open part 10 from the peripheral edge portion 5 until the first and second interruption points 20', 20" are reached.

The first portion 11' of the first tear line extends along the contour line 8 between the first intersection 13' and the first interruption point 20', and the second portion 11" of the first tear line extends along the contour line 8 between the second intersection 13" and the second interruption point 20". Thus the entire first fully or partly removable tear-open part 10 except for the portion constituting the first hinged folding line 14 extending between the first and second interruption points 20', 20" has been separated from the sealing disc 1 and can be folded outwards to enable access to the content inside the packaging container 100 through a first access opening 23.

The second fully or partly removable tear-open part 30 may be fully or partly removed from the sealing disc 1 as follows:

The tearing action starts by grabbing and pulling the opening arrangement 9" provided on the second fully or partly removable tear-open part 30 thereby separating the second fully or partly removable tear-open part 30 from the section 40 to remain along the second separating tear line 34. The tearing action is propagated towards the third and fourth intersections 39', 39" arranged on the contour line 8 and when the tear reaches the third and fourth intersections 39', 39", it is interrupted and is thereafter continued along the second tear line 31 until the entire second fully or partly removable tear-open part 30 is separated from the peripheral edge portion 5 and can be removed from the sealing disc 1.

However, if the second fully or partly removable tear-open part 30 is provided with a hinge folding line 33, the tearing action starts by separating the second fully or partly removable tear-open part 30 from the section 40 to remain along the second separating tear line 34, and thereafter it will continue along first and second portions 31', 31" of the second tear line, separating the second fully or partly removable tear-open part 30 from the peripheral edge portion 5 until the third and fourth interruption point 32', 32" are reached.

The first portion 31' of the second tear line extends along the contour line 8 between the third intersection 39' and the third interruption point 32', and the second portion 31" of the second tear line extends along the contour line 8 between the fourth intersection 39" and the fourth interruption point 32". Thus, the entire second fully or partly removable tear-open part 30 except for the portion constituting the second hinged folding line 33 extending between the third and fourth interruption points 32', 32" has been separated from the sealing disc 1 and can be folded outwards to enable access to the content inside the packaging container 100 through a second access opening. The section 40 to remain preferably has at least one straight edge allowing it to be used as a scraper bar.

In the illustrations disclosed herein, the fully or partly removable tear-open parts are arranged on the shorter edges of the generally rectangular packaging containers. However, it is conceivable that the fully or partly removable tear-open parts may be arranged also on the longer sides of the rectangular container, or in a corner portion of the container.

The sealing disc 1 as described herein is advantageously made from paperboard, aluminum foil, silicon-coated paper, plastic film or any combination thereof.

The packaging container 100 which is shown in FIGS. 5A-5H is a packaging container 100 for pourable or scoopable bulk solids as defined herein and comprises a container body 102 comprising a container wall including a front wall portion 103*a*, a rear wall portion 103*b* and two side wall portions 103*c*, 103*d*. The container wall extends from a container bottom 104 to a container opening 105. The container wall has an inner surface facing towards an inner compartment in the packaging container 100 and an outer surface facing away from the inner compartment and being exposed to the exterior of the packaging container 100. A bottom disc is positioned at the bottom 104 of the container body 102.

The container body 102 is made from paperboard material as defined herein. The container body 102 may be formed by bringing together the side edges of a web of paperboard causing the material to assume a tubular shape, whereafter the side edges are sealed together. Sealing of the side edges may be made by any suitable method as known in the art, such as by welding or gluing, with welding being preferred. Sealing of the side edges of the container body web may involve using a sealing strip, as known in the art. The bottom disc may be made from paperboard, metal, plastic, or from any suitable combination of such materials as known in the art. The body may be formed into any desired tubular shape including circular, oval, rectangular and modified rectangular shapes, such as the modified rectangular shape with rounded corners which is shown in FIGS. 5A-5H.

The container bottom 104 may alternatively be formed without a bottom disc by folding of the container wall material, as known in the art.

The paperboard packaging container 100 is provided with a closure arrangement at the container opening 105, such as a lid 114 provided with a grip tab.

The paperboard packaging container 100 may furthermore be provided with a locking arrangement for retaining the container lid 114 in a closed position after closure of the lid 114.

Moreover, the lid may be of the removable kind, without any permanent connection to the container body. It is further to be understood that the closure arrangement as shown in FIGS. 5A-5H is non-limiting and that the sealing disc 1 as disclosed herein may be used as a transport seal in packaging containers having other types of closure arrangements such as closure arrangements wherein a lid cooperates with a reinforcement rim or with a frame structure of the container body to close and open the packaging container. The lid may be provided as a part of a lid component. A lid component comprises a rim to which the lid is connected with a hinge. The rim is attached to the container body and stabilizes the container opening. The lid component may be provided with features such as locking means for keeping the lid in a closed position, tamper evidence means, stacking means, etc. as known in the art. Lid components are usually formed by injection molding of thermoplastic material The interior compartment is sealed with a sealing disc 1 as disclosed herein, e.g. a sealing disc 1 as shown in FIG. 2B. The sealing disc 1 forms a transport seal over packaged goods which are contained in the interior compartment. A peripheral edge portion 5 of the sealing disc 1 is attached to the container wall, e.g. by welding. The seal between the peripheral edge portion 5 and the container wall is preferably a gas-tight seal or at least a sift-proof seal. The sealing disc 1 may be attached to the container wall either from the top end of the container body 102 or from the bottom end of the container body 102, in which case it is attached before attaching the bottom disc 109. In the example shown in FIGS. 5A-5H, the sealing disc 1 has been applied from the top end of the container body 102, with the peripheral edge portion of the sealing disc 1 which is attached to the container wall being upwardly directed.

The procedure of gaining access to the packaging container sealed with a sealing disc as disclosed in FIG. 2B will now be described.

Figure 5A:
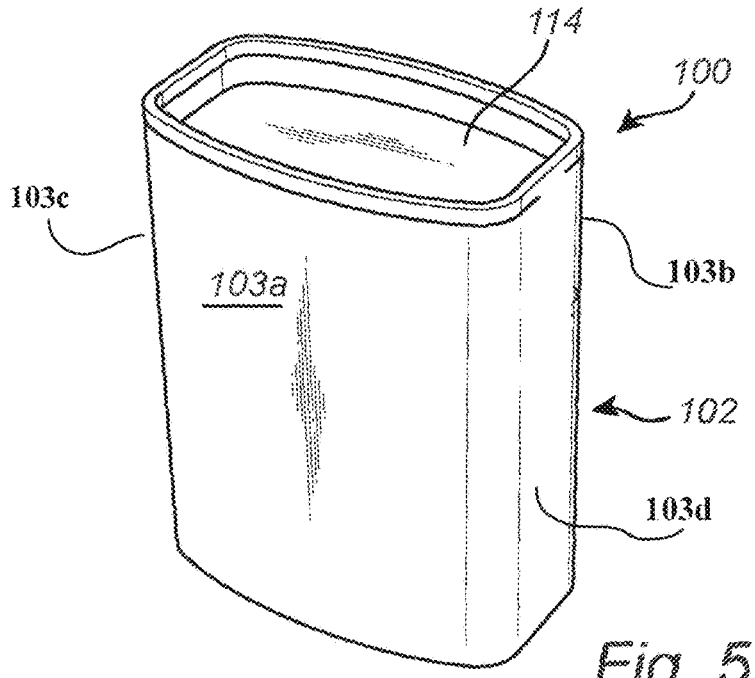
FIGS. 5A-5H show the steps for opening a paperboard container with a sealing disc as disclosed herein, and the steps for folding a pourable spout from a fully or partly removable tear-open part.
Figure 5B:
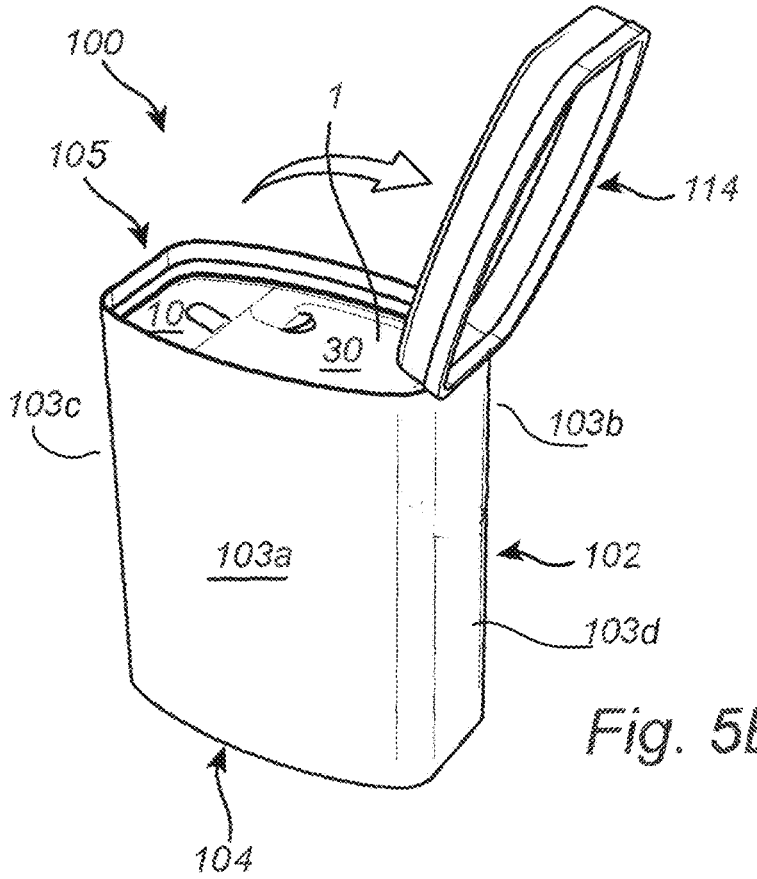
Figure 5C:
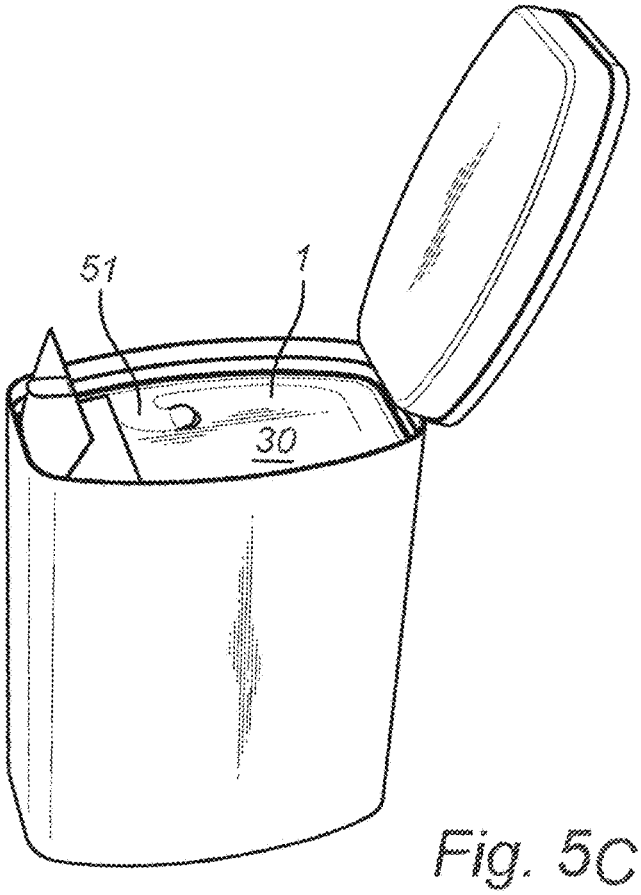
Figure 5D:
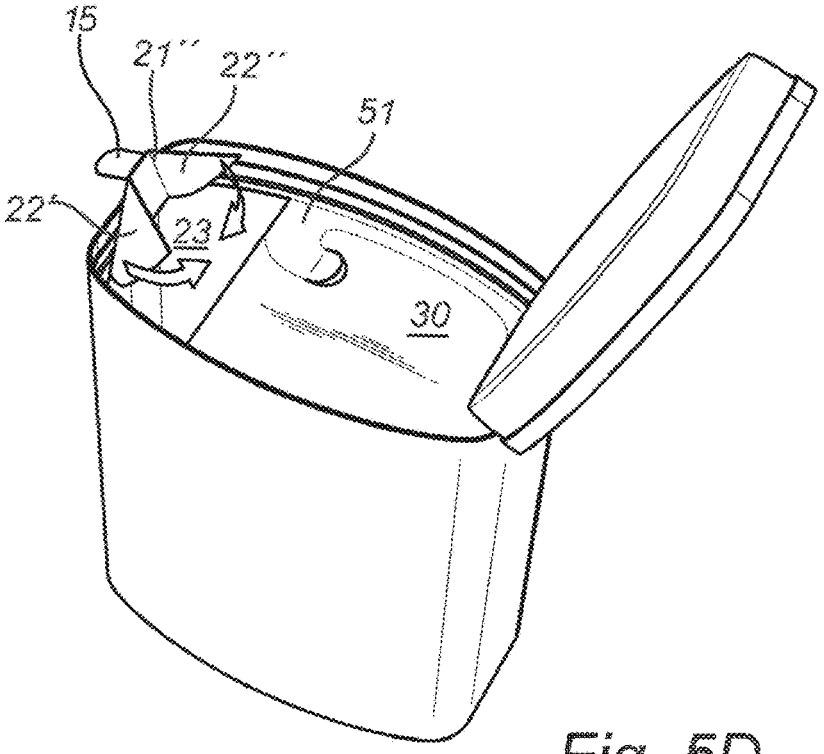
Figure 5E:
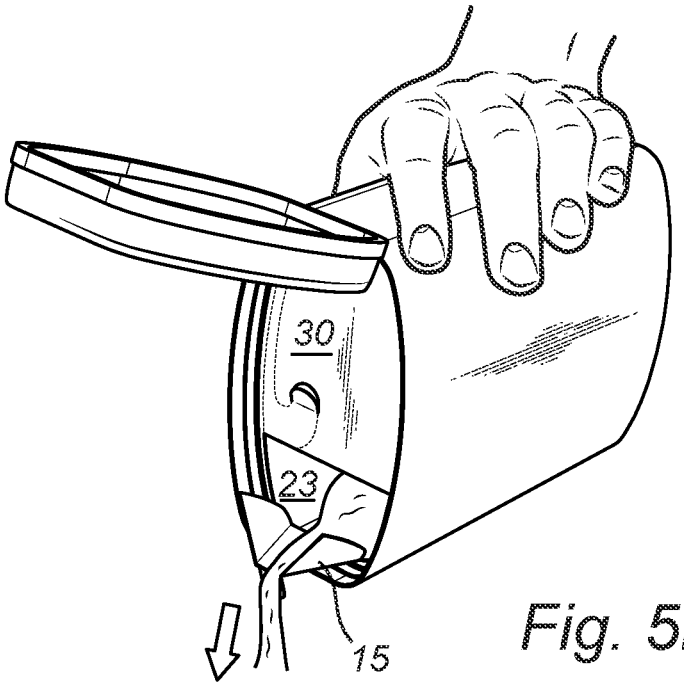
Figure 5F:
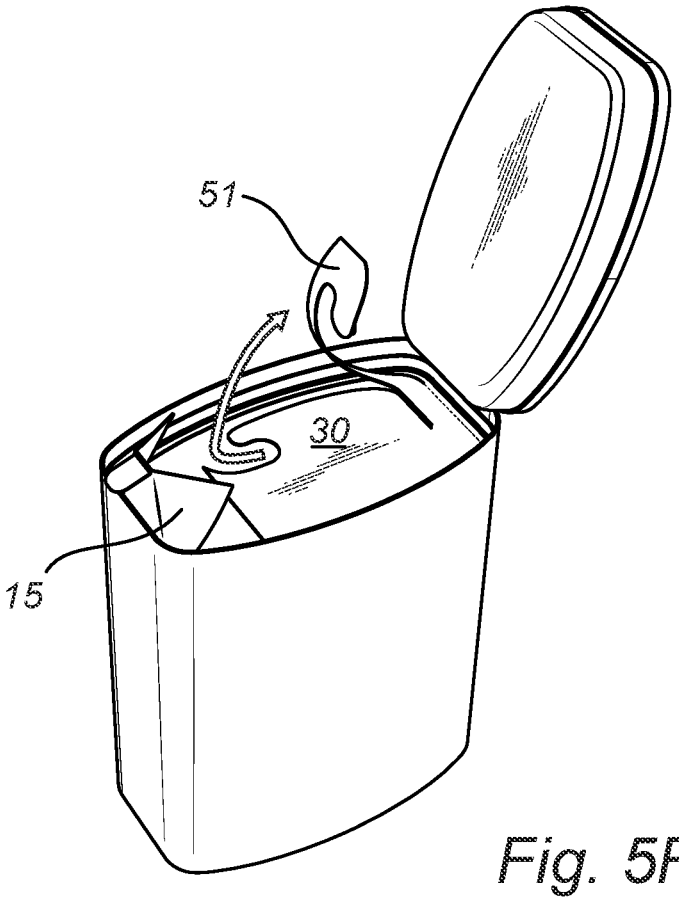

In order to gain a first access to the packaged goods, a user needs to open the lid 114 (see FIG. 5B) and then expose the packaged goods by gripping the pull-tab 9' of the first fully or partly removable tear-open part 10 to either fully or partly removing one or more of the fully or partly removable tear-open parts 10, 30 of the sealing disc 1 (see FIG. 5C). In FIG. 5C it is seen that the first fully or partly removable tear-open part 10 has been partly opened since it is provided with a first hinge folding line (not shown), and folded upwards and away from the first surface 3 of the sealing disc 1. The fully or partly removable tear-open part 10 is provided with first spout folding lines 21', 21" on the second surface 4 of the sealing disc 1 and the outer edges 22', 22" of the first fully or partly removable tear-open part 10 have been folded to form a pouring spout 15 (see FIG. 5D). The content may now be poured from the container 100 through the first access opening 23 by means of the pouring spout 15.

Figure 5G:
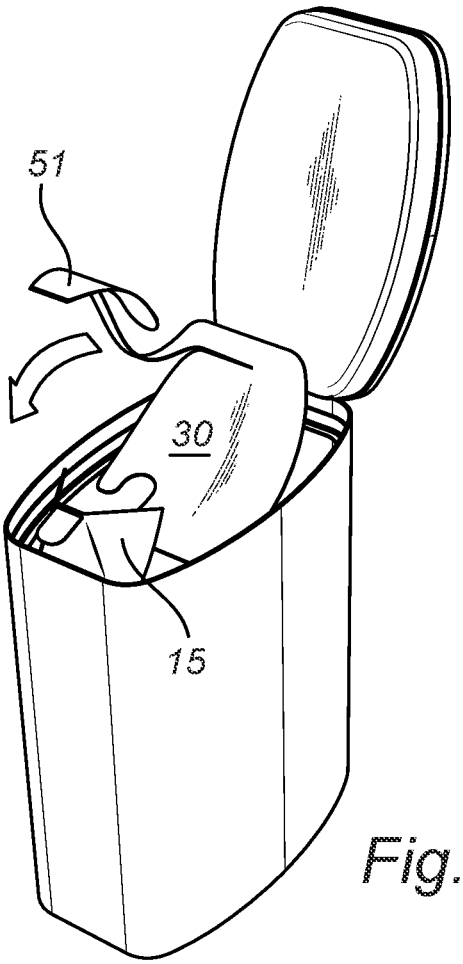
Figure 5H:
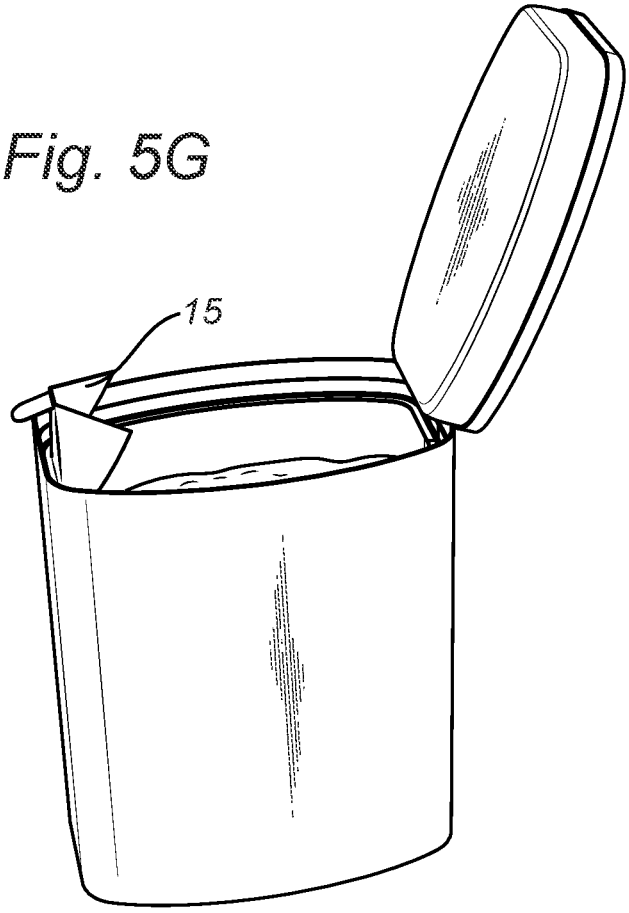

If a larger access opening is required, the user may use the tear strip 51 to open also the second fully or partly removable tear-open part 30 (see FIGS. 5F) and remove it completely from the sealing disc 1 (see FIG. 5G). The second fully or partly removable tear-open part 30 contains no hinge folding line and can therefore be removed completely.

Once one or more of the fully or partly removable tear-open parts 10, 30 have been removed, it is sufficient to open the lid 114 in order to gain access to the packaged goods in the interior compartment through the container opening 105.

The invention claimed is:

1. A sealing disc for sealing an inner compartment in a packaging container said sealing disc having a first surface and a second surface and being delimited by a sealing disc outer edge said sealing disc comprising a peripheral edge portion surrounding a first removable tear open part and a second removable tear open part, each of the first removable tear open part and the second removable tear open part being arranged to be separated, independent of each other, from said peripheral edge portion along a contour line, and a hinge folding line arranged between a pair of interruption points on said contour line partly delimiting the first removable tear open part from said peripheral edge portion, the first removable tear open part is provided with spout folding lines extending from said pair of interruption points to a separating tear line on said second surface of sealing disc to form a pouring spout.

2. The sealing disc according to claim 1, wherein at least one of the first removable tear open part and the second removable tear open part is provided with an opening arrangement such as a pull-tab or a push-tab.

3. The sealing disc according to claim 1, wherein one or more separating tear lines extending between one or more pairs of intersections arranged on the contour line delimit the first removable tear open part and the second removable tear open part from each other.

4. The sealing disc according to claim 3, wherein a tear line arranged along said contour line partly delimits the first removable tear open part from said peripheral edge portion.

5. The sealing disc according to claim 1, the first removable tear open part is smaller than the second removable tear-open part.

6. The sealing disc according to claim 1 wherein a first separating tear line extending between a first and a second intersection arranged on said contour line, delimits the first removable tear open part from said second removable tear-open part, and a first tear line extending along said contour line from the first intersection to the second intersection delimits the first removable tear open part from said peripheral edge portion.

7. The sealing disc according to claim 6, wherein a second tear line extending along said contour line from said second intersection to said first intersection delimits said second removable tear-open part from said peripheral edge portion.

8. The sealing disc according to claim 7 wherein said second removable tear-open part is provided with a tear-strip being part of said second removable tear-open part.

9. The sealing disc according to claim 1, wherein said sealing disc is made from paperboard, aluminum foil, silicon-coated paper, plastic film or a combination thereof.

10. A packaging container comprising the sealing disc according to claim 1, wherein said packaging container comprises a container body comprising a container wall extending from a container bottom to a container opening and a closure arrangement comprising a lid, said peripheral edge portion of said sealing disc being attached to an inner surface of said container wall, said sealing disc forming a seal across said container opening.

11. The packaging container according to claim 10, wherein the packaging container is a paperboard packaging container.

12. The packaging container according to claim 10 wherein the sealing disc is a container lid.

13. The packaging container according to claim 10, wherein said sealing disc is a transport closure.

14. The packaging container according to claim 10, comprising a rim secured to the container body wherein the lid is attached to the rim.

15. A sealing disc for sealing an inner compartment in a packaging container said sealing disc having a first surface and a second surface and being delimited by a sealing disc outer edge said sealing disc comprising a peripheral edge portion surrounding a first removable tear open part and a second removable tear open part, each of the first removable tear open part and the second removable tear open part being arranged to be separated, independent of each other, from said peripheral edge portion along a contour line, and a hinge folding line arranged between a pair of interruption points on said contour line partly delimiting the first removable tear open part from said peripheral edge portion, a first separating tear line extending between a first and a second intersection arranged on said contour line, delimits the first removable tear open part from said second removable tear-open part, and a first tear line extending along said contour line from the first intersection to the second intersection delimits the first removable tear open part from said peripheral edge portion, a second tear line extending along said contour line from said second intersection to said first intersection delimits said second removable tear-open part from said peripheral edge portion, said second removable tear-open part is provided with a tear-strip being part of said second removable tear-open part, wherein said second tear line extends from said first intersection through said second intersection and to an end point, said first intersection and said second intersection being arranged on said contour line, and said end point being arranged within said second tear-open part and wherein a first portion of said second tear line extending between said first intersection and said second intersection along said contour line constitutes a contour section of said contour line and a second portion of said second tear line extending between said second intersection and said end point constitutes a tear-strip section said tear strip section delimiting a pull tab and an inner edge of said tear strip.

16. A sealing disc for sealing an inner compartment in a packaging container said sealing disc having a first surface and a second surface and being delimited by a sealing disc outer edge said sealing disc comprising a peripheral edge portion surrounding a first removable tear open part and a second removable tear open part, each of the first removable tear open part and the second removable tear open part being arranged to be separated, independent of each other, from said peripheral edge portion along a contour line, and a hinge folding line arranged between a pair of interruption points on said contour line partly delimiting the first removable tear open part from said peripheral edge portion, a first separating tear line extending between a first and a second intersection arranged on said contour line, delimits the first removable tear open part from said second removable tear-open part, and a first tear line extending along said contour line from the first intersection to the second intersection delimits the first removable tear open part from said peripheral edge portion, a second tear line extending along said contour line from said second intersection to said first intersection delimits said second removable tear-open part from said peripheral edge portion, wherein a third interruption point and a fourth interruption point are arranged along said second tear line with a second hinge folding line arranged between said third and said fourth interruption points.

17. The sealing disc according to claim 16, wherein said second removable tear-open part is provided with spout folding lines extending from said third and fourth interruption points to said first separating tear line on said second surface of said sealing disc to form a pouring spout.

18. A sealing disc for sealing an inner compartment in a packaging container said sealing disc having a first surface and a second surface and being delimited by a sealing disc outer edge said sealing disc comprising a peripheral edge portion surrounding a first removable tear open part and a second removable tear open part, each of the first removable tear open part and the second removable tear open part being arranged to be separated, independent of each other, from said peripheral edge portion along a contour line, and a hinge folding line arranged between a pair of interruption points on said contour line partly delimiting the first removable tear open part from said peripheral edge portion, further comprising a section not to be removed from said sealing disc wherein a first separating tear line extending between a pair of first and second intersections arranged on said contour line, delimits said first removable tear-open part from said section not to be removed; and a second separating tear line extending between a pair of third and fourth intersections arranged on said contour line delimits said second removable tear-open part from said section not to be removed;

a first tear line extending along said contour line from a first intersection to a second intersection of said first pair of intersections delimits said first removable tear-open part from said peripheral edge portion; and a second tear line extending along said contour line between a third intersection and a fourth intersection of said second pair of intersections delimits said second removable tear-open part from said peripheral edge portion.

19. The sealing disc according to claim 18, wherein said first removable tear-open part is provided with first spout folding lines extending from said pair of interruption points to said first separating tear line on said second surface of said sealing disc.

20. The sealing disc according to claim 18, wherein a third interruption point and a fourth interruption point are arranged along said second tear line with a second hinge folding line arranged between said third and fourth interruption points.

21. The sealing disc according to claim 20, wherein said second removable tear-open part is provided with second spout folding lines extending from said third and fourth interruption points to said second separating tear line on said second surface.

* * * * *